US011471729B2

(12) United States Patent
Hacking et al.

(10) Patent No.: US 11,471,729 B2
(45) Date of Patent: Oct. 18, 2022

(54) SYSTEM, METHOD AND APPARATUS FOR A REHABILITATION MACHINE WITH A SIMULATED FLYWHEEL

(71) Applicant: ROM TECHNOLOGIES, INC., Brookfield, CT (US)

(72) Inventors: S. Adam Hacking, Nashua, NH (US); Daniel Lipszyc, Glasgow, MT (US)

(73) Assignee: ROM Technologies, Inc., Brookfield, CT (US)

( * ) Notice: Subject to any disclaimer, the term of this patent is extended or adjusted under 35 U.S.C. 154(b) by 199 days.

(21) Appl. No.: 16/813,158

(22) Filed: Mar. 9, 2020

(65) Prior Publication Data

US 2020/0289879 A1 Sep. 17, 2020

Related U.S. Application Data

(60) Provisional application No. 62/816,550, filed on Mar. 11, 2019, provisional application No. 62/816,557, filed on Mar. 11, 2019.

(51) Int. Cl.
*A63B 22/06* (2006.01)
*A61H 1/02* (2006.01)
(Continued)

(52) U.S. Cl.
CPC ..... *A63B 22/0605* (2013.01); *A61H 1/0214* (2013.01); *A63B 21/0058* (2013.01);
(Continued)

(58) Field of Classification Search
CPC ..... A63B 22/06–2022/0658; A63B 24/0062; A63B 24/0087; A63B 2024/0093;
(Continued)

(56) References Cited

U.S. PATENT DOCUMENTS 59,915 A 11/1866 Lallement
363,522 A 5/1887 Knous
(Continued)

FOREIGN PATENT DOCUMENTS

CA 2698078 A1 3/2010
CN 112603295 A 2/2003
(Continued)

OTHER PUBLICATIONS

Claris Healthcare Inc., Claris Reflex Patient Rehabilitation System Brochure, https://clarisreflex.com/, retrieved from internet on Oct. 2, 2019, 5 pages.
(Continued)

*Primary Examiner* — Jennifer Robertson
(74) *Attorney, Agent, or Firm* — Dickinson Wright, PLLC; Stephen A. Mason; Jonathan H. Harder

(57) ABSTRACT

Electromechanical rehabilitation of a user can include receiving a pedal force value from a pedal sensor of a pedal; receiving a pedal rotational position; based on the pedal rotational position over a period of time, calculating a pedal velocity; and based at least upon the pedal force value, a set pedal resistance value, and the pedal velocity, outputting one or more control signals causing an electric motor to provide a driving force to control simulated rotational inertia applied to the pedal.

19 Claims, 13 Drawing Sheets

(51) Int. Cl.

| | |
|---|---|
| ***A63B 21/00*** | (2006.01) |
| ***A63B 24/00*** | (2006.01) |
| ***A63B 21/005*** | (2006.01) |
| ***A63B 21/22*** | (2006.01) |
| ***A63B 71/00*** | (2006.01) |
| ***A63B 71/02*** | (2006.01) |

(52) U.S. Cl.

CPC .... *A63B 21/0059* (2015.10); *A63B 21/00072* (2013.01); *A63B 21/00076* (2013.01); *A63B 21/00178* (2013.01); *A63B 21/154* (2013.01); *A63B 21/4034* (2015.10); *A63B 22/0664* (2013.01); *A63B 24/0062* (2013.01); *A63B 24/0087* (2013.01); *A63B 21/227* (2013.01); *A63B 2022/0682* (2013.01); *A63B 2024/0068* (2013.01); *A63B 2024/0093* (2013.01); *A63B 2071/009* (2013.01); *A63B 2071/025* (2013.01); *A63B 2210/50* (2013.01); *A63B 2220/10* (2013.01); *A63B 2220/24* (2013.01); *A63B 2220/34* (2013.01); *A63B 2220/44* (2013.01); *A63B 2220/51* (2013.01); *A63B 2220/62* (2013.01); *A63B 2220/833* (2013.01); *A63B 2225/09* (2013.01); *A63B 2225/50* (2013.01)

(58) Field of Classification Search

CPC ..... A63B 21/00072; A63B 21/0058; A63B 21/154; A63B 21/4034; A63B 2220/51; A63B 2220/833; A61H 1/0214

See application file for complete search history.

(56) References Cited

U.S. PATENT DOCUMENTS

| | | | | |
|---|---|---|---|---|
| 446,671 | A | 2/1891 | Elliott | |
| 610,157 | A | 8/1898 | Campbell | |
| 631,276 | A | 8/1899 | Bulova | |
| 823,712 | A | 6/1906 | Uhlmann | |
| 1,149,029 | A | 8/1915 | Clark | |
| 1,227,743 | A | 5/1917 | Burgedorfp | |
| 1,784,230 | A | 12/1930 | Freeman | |
| 3,081,645 | A | 3/1963 | Bergfors | |
| 3,100,640 | A | 8/1963 | Weitzel | |
| 3,137,014 | A | 6/1964 | Meucci | |
| 3,143,316 | A | 8/1964 | Shapiro | |
| 3,713,438 | A | 1/1973 | Knutsen | |
| 3,744,480 | A | 7/1973 | Gause et al. | |
| 3,888,136 | A | 6/1975 | Lapeyre | |
| 4,079,957 | A | 3/1978 | Blease | |
| 4,408,613 | A | 10/1983 | Relyea | |
| 4,436,097 | A | 3/1984 | Cunningham | |
| 4,446,753 | A | 5/1984 | Nagano | |
| 4,477,072 | A | 10/1984 | DeCloux | |
| 4,499,900 | A | 2/1985 | Petrofsky et al. | |
| 4,509,742 | A | 4/1985 | Cones | |
| 4,606,241 | A | 8/1986 | Fredriksson | |
| 4,611,807 | A | 9/1986 | Castillo | |
| 4,616,823 | A | 10/1986 | Yang | |
| 4,648,287 | A | 3/1987 | Preskitt | |
| 4,673,178 | A | 6/1987 | Dwight | |
| 4,822,032 | A | 4/1989 | Whitmore et al. | |
| 4,824,104 | A | 4/1989 | Bloch | |
| 4,850,245 | A | 7/1989 | Feamster et al. | |
| 4,858,942 | A | 8/1989 | Rodriguez | |
| 4,869,497 | A | 9/1989 | Stewart et al. | |
| 4,915,374 | A | 4/1990 | Watkins | |
| 4,930,768 | A | 6/1990 | Lapcevic | |
| 4,961,570 | A | 10/1990 | Chang | |
| 5,161,430 | A | 11/1992 | Febey | |
| 5,202,794 | A | 4/1993 | Schnee et al. | |
| 5,240,417 | A | 8/1993 | Smithson et al. | |
| 5,247,853 | A | 9/1993 | Dalebout | |
| 5,256,115 | A * | 10/1993 | Scholder | A63B 22/0605 601/36 |
| 5,256,117 | A | 10/1993 | Potts et al. | |
| D342,299 | S | 12/1993 | Birrell et al. | |
| 5,282,748 | A | 2/1994 | Little | |
| 5,284,131 | A | 2/1994 | Gray | |
| 5,316,532 | A | 5/1994 | Butler | |
| 5,324,241 | A | 6/1994 | Artigues et al. | |
| 5,336,147 | A | 8/1994 | Sweeney, III | |
| 5,338,272 | A | 8/1994 | Sweeney, III | |
| 5,361,649 | A | 11/1994 | Slocum, Jr. | |
| D353,421 | S | 12/1994 | Gallivan | |
| 5,429,140 | A | 7/1995 | Burdea et al. | |
| 5,458,022 | A | 10/1995 | Mattfeld et al. | |
| 5,487,713 | A | 1/1996 | Butler | |
| 5,566,589 | A | 10/1996 | Buck | |
| 5,580,338 | A | 12/1996 | Scelta et al. | |
| 5,676,349 | A | 10/1997 | Wilson | |
| 5,685,804 | A | 11/1997 | Whan-Tong et al. | |
| 5,860,941 | A | 1/1999 | Saringer et al. | |
| 5,950,813 | A | 9/1999 | Hoskins et al. | |
| 6,053,847 | A | 4/2000 | Stearns et al. | |
| 6,077,201 | A | 6/2000 | Cheng | |
| 6,102,834 | A | 8/2000 | Chen | |
| 6,155,958 | A | 12/2000 | Goldberg | |
| 6,182,029 | B1 | 1/2001 | Friedman | |
| D438,580 | S | 3/2001 | Shaw | |
| 6,253,638 | B1 | 7/2001 | Bermudez | |
| 6,267,735 | B1 | 7/2001 | Blanchard et al. | |
| 6,273,863 | B1 | 8/2001 | Avni et al. | |
| D450,100 | S | 11/2001 | Hsu | |
| D450,101 | S | 11/2001 | Hsu | |
| D451,972 | S | 12/2001 | Easley | |
| D452,285 | S | 12/2001 | Easley | |
| D454,605 | S | 3/2002 | Lee | |
| 6,371,891 | B1 | 4/2002 | Speas | |
| D459,776 | S | 7/2002 | Lee | |
| 6,413,190 | B1 | 7/2002 | Wood et al. | |
| 6,430,436 | B1 | 8/2002 | Richter | |
| 6,436,058 | B1 | 8/2002 | Krahner et al. | |
| 6,474,193 | B1 | 11/2002 | Farney | |
| 6,491,649 | B1 | 12/2002 | Ombrellaro | |
| 6,535,861 | B1 | 3/2003 | OConnor et al. | |
| 6,543,309 | B2 | 4/2003 | Heim | |
| D475,424 | S | 6/2003 | Lee | |
| 6,589,139 | B1 | 7/2003 | Butterworth | |
| 6,602,191 | B2 | 8/2003 | Ouy | |
| 6,607,465 | B1 | 8/2003 | Shoge | |
| 6,626,805 | B1 | 9/2003 | Lightbody | |
| D482,416 | S | 11/2003 | Yang | |
| 6,640,662 | B1 | 11/2003 | Baxter | |
| D484,931 | S | 1/2004 | Tsai | |
| 6,820,517 | B1 | 11/2004 | Farney | |
| 6,865,969 | B2 | 3/2005 | Stevens | |
| 6,890,312 | B1 | 5/2005 | Priester et al. | |
| 6,895,834 | B1 | 5/2005 | Baatz | |
| 7,156,665 | B1 | 1/2007 | OConnor et al. | |
| 7,169,085 | B1 | 1/2007 | Killin et al. | |
| 7,204,788 | B2 | 4/2007 | Andrews | |
| 7,209,886 | B2 | 4/2007 | Kimmel | |
| 7,226,394 | B2 | 6/2007 | Johnson | |
| 7,406,003 | B2 | 7/2008 | Burkhardt et al. | |
| D575,836 | S | 8/2008 | Hsiao | |
| 7,507,188 | B2 | 3/2009 | Nurre | |
| 7,594,879 | B2 | 9/2009 | Johnson | |
| 7,726,034 | B2 | 6/2010 | Wixey | |
| 7,778,851 | B2 | 8/2010 | Schoenberg et al. | |
| 7,809,601 | B2 | 10/2010 | Shaya et al. | |
| 7,833,135 | B2 * | 11/2010 | Radow | A63B 22/0605 482/4 |
| 7,955,219 | B2 | 6/2011 | Birrell et al. | |
| 7,974,689 | B2 | 7/2011 | Volpe et al. | |
| 7,988,599 | B2 | 8/2011 | Ainsworth et al. | |
| 8,079,937 | B2 | 12/2011 | Bedell et al. | |
| 8,287,434 | B2 | 10/2012 | Zavadsky et al. | |
| 8,419,593 | B2 | 4/2013 | Ainsworth et al. | |
| 8,506,458 | B2 | 8/2013 | Dugan | |
| 8,540,515 | B2 | 9/2013 | Williams et al. | |
| 8,540,516 | B2 | 9/2013 | Williams et al. | |

(56) References Cited

U.S. PATENT DOCUMENTS 8,556,778 B1 10/2013 Dugan
8,613,689 B2 12/2013 Dyer et al.
8,672,812 B2 3/2014 Dugan
8,751,264 B2 6/2014 Beraja et al.
8,784,273 B2 7/2014 Dugan
8,823,448 B1 9/2014 Shen
8,979,711 B2 3/2015 Dugan
9,044,630 B1 6/2015 Lampert et al.
9,167,281 B2 10/2015 Petrov et al.
D744,050 S 11/2015 Colburn
9,248,071 B1 2/2016 Benda et al.
9,272,185 B2 3/2016 Dugan
9,283,434 B1 * 3/2016 Wu ..... A61B 5/6895
9,311,789 B1 4/2016 Gwin
9,312,907 B2 4/2016 Auchinleck et al.
9,367,668 B2 6/2016 Flynt et al.
9,409,054 B2 8/2016 Dugan
9,443,205 B2 9/2016 Wall
9,480,873 B2 11/2016 Chuang
9,481,428 B2 11/2016 Gros et al.
9,566,472 B2 2/2017 Dugan
9,579,056 B2 2/2017 Rosenbek et al.
9,629,558 B2 4/2017 Yuen et al.
9,713,744 B2 7/2017 Suzuki
D793,494 S 8/2017 Mansfield et al.
D794,142 S 8/2017 Zhou
9,717,947 B2 8/2017 Lin
9,737,761 B1 8/2017 Govindarajan
9,872,087 B2 1/2018 DelloStritto et al.
9,872,637 B2 1/2018 Kording et al.
9,914,053 B2 3/2018 Dugan
9,937,382 B2 4/2018 Dugan
9,939,784 B1 4/2018 Berardinelli
10,074,148 B2 9/2018 Cashman et al.
10,130,298 B2 11/2018 Mokaya et al.
10,155,134 B2 12/2018 Dugan
10,159,872 B2 12/2018 Sasaki et al.
10,173,094 B2 1/2019 Gomberg
10,173,095 B2 1/2019 Gomberg et al.
10,173,096 B2 1/2019 Gomberg et al.
10,173,097 B2 1/2019 Gomberg et al.
10,226,663 B2 3/2019 Gomberg et al.
10,254,804 B2 4/2019 Dusan
10,325,070 B2 6/2019 Beale et al.
10,327,697 B1 6/2019 Stein et al.
10,430,552 B2 10/2019 Mihai
10,542,914 B2 1/2020 Forth et al.
10,546,467 B1 1/2020 Luciano, Jr. et al.
10,569,122 B2 2/2020 Johnson
10,572,626 B2 2/2020 Balram
10,576,331 B2 3/2020 Kuo
10,625,114 B2 4/2020 Ercanbrack
10,646,746 B1 5/2020 Gomberg et al.
10,660,534 B2 5/2020 Lee et al.
10,678,890 B2 6/2020 Bitran et al.
10,685,092 B2 6/2020 Paparella et al.
10,705,619 B2 7/2020 Johri
10,777,200 B2 9/2020 Will et al.
10,792,495 B2 10/2020 Izvorski et al.
10,874,905 B2 12/2020 Belson et al.
D907,143 S 1/2021 Ach et al.
10,931,643 B1 2/2021 Neumann
11,000,735 B2 5/2021 Orady et al.
11,040,238 B2 6/2021 Colburn
11,045,709 B2 6/2021 Putnam
11,065,527 B2 7/2021 Putnam
11,069,436 B2 7/2021 Mason et al.
11,071,597 B2 7/2021 Posnack et al.
11,075,000 B2 7/2021 Mason et al.
D928,635 S 8/2021 Hacking et al.
11,087,865 B2 8/2021 Mason et al.
11,101,028 B2 8/2021 Mason et al.
11,107,591 B1 8/2021 Mason
11,139,060 B2 10/2021 Mason et al.
11,185,735 B2 11/2021 Arn et al.
D939,644 S 12/2021 Ach et al.
D940,797 S 1/2022 Ach et al.
11,229,727 B2 1/2022 Tatonetti
11,270,795 B2 3/2022 Mason et al.
11,282,599 B2 3/2022 Mason et al.
11,282,604 B2 3/2022 Mason et al.
11,282,608 B2 3/2022 Mason et al.
11,284,797 B2 3/2022 Mason et al.
D948,639 S 4/2022 Ach et al.
11,295,848 B2 4/2022 Mason et al.
11,309,085 B2 4/2022 Mason et al.
11,317,975 B2 5/2022 Mason et al.
11,325,005 B2 5/2022 Mason et al.
11,328,807 B2 5/2022 Mason et al.
11,337,648 B2 5/2022 Mason
11,348,683 B2 5/2022 Guaneri et al.
11,404,150 B2 8/2022 Guaneri et al.
11,410,768 B2 8/2022 Mason et al.
2002/0072452 A1 6/2002 Torkelson
2002/0160883 A1 10/2002 Dugan
2003/0036683 A1 2/2003 Kehr et al.
2003/0045402 A1 3/2003 Pyle
2003/0064863 A1 4/2003 Chen
2003/0083596 A1 5/2003 Kramer et al.
2003/0092536 A1 5/2003 Romanelli et al.
2003/0109814 A1 6/2003 Rummerfield
2004/0102931 A1 5/2004 Ellis et al.
2004/0106502 A1 6/2004 Sher
2004/0147969 A1 7/2004 Mann et al.
2004/0172093 A1 9/2004 Rummerfield
2004/0194572 A1 10/2004 Kim
2005/0015118 A1 1/2005 Davis et al.
2005/0020411 A1 1/2005 Andrews
2005/0043153 A1 2/2005 Krietzman
2005/0049122 A1 3/2005 Vallone et al.
2005/0085346 A1 4/2005 Johnson
2005/0085353 A1 4/2005 Johnson
2005/0274220 A1 12/2005 Reboullet
2006/0003871 A1 1/2006 Houghton
2006/0064329 A1 3/2006 Abolfathi et al.
2006/0247095 A1 11/2006 Rummerfield
2007/0042868 A1 2/2007 Fisher et al.
2007/0137307 A1 6/2007 Gruben et al.
2007/0173392 A1 7/2007 Stanford
2007/0287597 A1 12/2007 Cameron
2008/0021834 A1 1/2008 Holla et al.
2008/0153592 A1 6/2008 James-Herbert
2008/0161166 A1 7/2008 Lo
2008/0300914 A1 12/2008 Karkanias et al.
2009/0011907 A1 1/2009 Radow et al.
2009/0046056 A1 2/2009 Rosenberg et al.
2009/0058635 A1 3/2009 LaLonde et al.
2009/0070138 A1 3/2009 Langheier et al.
2009/0211395 A1 8/2009 Mul'e
2009/0270227 A1 10/2009 Ashby et al.
2010/0048358 A1 2/2010 Tchao
2010/0121160 A1 5/2010 Stark et al.
2010/0173747 A1 7/2010 Chen et al.
2010/0248899 A1 9/2010 Bedell et al.
2010/0248905 A1 9/2010 Lu
2010/0268304 A1 10/2010 Matos
2011/0047108 A1 2/2011 Chakrabarty et al.
2011/0172059 A1 7/2011 Watterson et al.
2011/0218814 A1 9/2011 Coats
2011/0275483 A1 11/2011 Dugan
2012/0065987 A1 3/2012 Farooq et al.
2012/0167709 A1 7/2012 Chen et al.
2012/0183939 A1 7/2012 Aragones et al.
2012/0190502 A1 7/2012 Paulus et al.
2012/0295240 A1 11/2012 Walker et al.
2012/0310667 A1 12/2012 Altman et al.
2013/0123667 A1 5/2013 Komatireddy et al.
2013/0137550 A1 5/2013 Skinner et al.
2013/0178334 A1 7/2013 Brammer
2013/0296987 A1 11/2013 Rogers et al.
2013/0318027 A1 11/2013 Mmogy et al.
2014/0006042 A1 1/2014 Keefe et al.
2014/0011640 A1 1/2014 Dugan
2014/0155129 A1 6/2014 Dugan

(56) References Cited

U.S. PATENT DOCUMENTS

2014/0172460 A1 6/2014 Kohli
2014/0188009 A1 7/2014 Lange et al.
2014/0194250 A1 7/2014 Reich et al.
2014/0194251 A1 7/2014 Reich et al.
2014/0207264 A1 7/2014 Ouy
2014/0207486 A1 7/2014 Carty et al.
2014/0246499 A1 9/2014 Proud et al.
2014/0256511 A1 9/2014 Smith
2014/0257837 A1 9/2014 Walker et al.
2014/0274622 A1 9/2014 Leonhard
2014/0309083 A1 10/2014 Dugan
2014/0322686 A1 10/2014 Kang
2015/0088544 A1 3/2015 Goldberg
2015/0151162 A1 6/2015 Dugan
2015/0158549 A1 6/2015 Gros et al.
2015/0161331 A1 6/2015 Oleynik
2015/0290061 A1 10/2015 Stafford et al.
2015/0339442 A1 11/2015 Oleynik
2015/0341812 A1 11/2015 Dion et al.
2015/0379232 A1 12/2015 Mainwaring et al.
2016/0007885 A1 1/2016 Basta et al.
2016/0023081 A1 1/2016 Popa-Simil
2016/0117471 A1 4/2016 Belt et al.
2016/0140319 A1 5/2016 Stark et al.
2016/0151670 A1 6/2016 Dugan
2016/0166881 A1 6/2016 Ridgel et al.
2016/0275259 A1 9/2016 Nolan et al.
2016/0302721 A1 10/2016 Wiedenhoefer et al.
2016/0317869 A1 11/2016 Dugan
2016/0322078 A1 11/2016 Bose et al.
2016/0325140 A1 11/2016 Wu
2016/0332028 A1 11/2016 Melnik
2017/0004260 A1 1/2017 Moturu et al.
2017/0014671 A1 1/2017 Burns, Sr.
2017/0033375 A1 2/2017 Ohmori et al.
2017/0046488 A1 2/2017 Pereira
2017/0065851 A1 3/2017 Deluca et al.
2017/0080320 A1 3/2017 Smith
2017/0095670 A1 4/2017 Ghaffar et al.
2017/0095692 A1 4/2017 Chang et al.
2017/0095693 A1 4/2017 Chang et al.
2017/0106242 A1 4/2017 Dugan
2017/0113092 A1 4/2017 Johnson
2017/0128769 A1 5/2017 Long et al.
2017/0132947 A1 5/2017 Maeda et al.
2017/0136296 A1 5/2017 Barrera et al.
2017/0143261 A1 5/2017 Wiedenhoefer et al.
2017/0147789 A1 5/2017 Wiedenhoefer et al.
2017/0168555 A1 6/2017 Munoz et al.
2017/0181698 A1 6/2017 Wiedenhoefer et al.
2017/0190052 A1 7/2017 Jaekel et al.
2017/0209766 A1 7/2017 Riley et al.
2017/0243028 A1 8/2017 LaFever et al.
2017/0265800 A1 9/2017 Auchinleck et al.
2017/0266501 A1 9/2017 Sanders et al.
2017/0278209 A1 9/2017 Olsen et al.
2017/0282015 A1 10/2017 Wicks et al.
2017/0300654 A1 10/2017 Stein et al.
2017/0312614 A1 11/2017 Tran et al.
2017/0329917 A1 11/2017 McRaith et al.
2017/0333755 A1 11/2017 Rider
2017/0337033 A1 11/2017 Duyan et al.
2017/0337334 A1 11/2017 Stanczak
2017/0344726 A1 11/2017 Duffy et al.
2017/0360586 A1 12/2017 Dempers et al.
2017/0368413 A1 12/2017 Shavit
2018/0017806 A1 1/2018 Wang et al.
2018/0052962 A1 2/2018 Van Der Koijk et al.
2018/0056104 A1 3/2018 Cromie et al.
2018/0071565 A1 3/2018 Gomberg et al.
2018/0071566 A1 3/2018 Gomberg et al.
2018/0071569 A1 3/2018 Gomberg et al.
2018/0071570 A1 3/2018 Gomberg et al.
2018/0071571 A1 3/2018 Gomberg et al.
2018/0071572 A1 3/2018 Gomberg et al.
2018/0075205 A1 3/2018 Moturu et al.
2018/0078843 A1 3/2018 Tran et al.
2018/0102190 A1 4/2018 Hogue et al.
2018/0178061 A1 6/2018 O'larte et al.
2018/0199855 A1 7/2018 Odame et al.
2018/0200577 A1 7/2018 Dugan
2018/0220935 A1 8/2018 Tadano et al.
2018/0228682 A1 8/2018 Bayerlein et al.
2018/0240552 A1 8/2018 Tuyl et al.
2018/0253991 A1 9/2018 Tang et al.
2018/0263530 A1 9/2018 Jung
2018/0271432 A1 9/2018 Auchinleck et al.
2018/0296157 A1 10/2018 Bleich et al.
2018/0330058 A1 11/2018 Bates
2018/0330824 A1 11/2018 Athey et al.
2018/0360340 A1 12/2018 Rehse et al.
2018/0373844 A1 12/2018 Ferrandez-Escamez et al.
2019/0019578 A1 1/2019 Vaccaro
2019/0030415 A1 1/2019 Volpe, Jr.
2019/0031284 A1* 1/2019 Fuchs ..... A63B 22/0605
2019/0035043 A1 1/2019 Jones et al.
2019/0060708 A1 2/2019 Fung
2019/0065970 A1 2/2019 Bonutti et al.
2019/0066832 A1 2/2019 Kang et al.
2019/0076701 A1 3/2019 Dugan
2019/0088356 A1 3/2019 Oliver et al.
2019/0091506 A1 3/2019 Gatelli et al.
2019/0111299 A1 4/2019 Radcliffe et al.
2019/0115097 A1 4/2019 Macoviak et al.
2019/0126099 A1 5/2019 Hoang
2019/0132948 A1 5/2019 Longinotti-Buitoni et al.
2019/0134454 A1 5/2019 Mahoney et al.
2019/0137988 A1 5/2019 Celia et al.
2019/0167988 A1 6/2019 Shahriari et al.
2019/0172587 A1 6/2019 Park et al.
2019/0175988 A1 6/2019 Volterrani et al.
2019/0200920 A1 7/2019 Fien et al.
2019/0209891 A1 7/2019 Fung
2019/0240541 A1 8/2019 Denton et al.
2019/0244540 A1 8/2019 Errante et al.
2019/0269343 A1 9/2019 Ramos Murguialday et al.
2019/0274523 A1 9/2019 Bates et al.
2019/0304584 A1 10/2019 Savolainen
2019/0307983 A1 10/2019 Goldman
2019/0354632 A1 11/2019 Mital et al.
2019/0366146 A1 12/2019 Tong et al.
2019/0388728 A1 12/2019 Wang et al.
2020/0005928 A1 1/2020 Daniel
2020/0051446 A1 2/2020 Rubinstein et al.
2020/0066390 A1 2/2020 Svendrys et al.
2020/0093418 A1 3/2020 Kluger et al.
2020/0143922 A1 5/2020 Chekroud et al.
2020/0151595 A1 5/2020 Jayalath et al.
2020/0151646 A1 5/2020 De La Fuente Sanchez
2020/0152339 A1 5/2020 Pulitzer et al.
2020/0160198 A1 5/2020 Reeves et al.
2020/0285322 A1 5/2020 Johri
2020/0170876 A1 6/2020 Kapure et al.
2020/0176098 A1 6/2020 Lucas et al.
2020/0197744 A1 6/2020 Schweighofer
2020/0221975 A1 7/2020 Basta et al.
2020/0267487 A1 8/2020 Siva
2020/0275886 A1 9/2020 Mason
2020/0289045 A1 9/2020 Hacking et al.
2020/0289046 A1 9/2020 Hacking et al.
2020/0289878 A1 9/2020 Arn et al.
2020/0289880 A1 9/2020 Hacking et al.
2020/0289881 A1 9/2020 Hacking et al.
2020/0289889 A1 9/2020 Hacking et al.
2020/0293712 A1 9/2020 Potts et al.
2020/0334972 A1 10/2020 Gopalakrishnan
2020/0357299 A1 11/2020 Patel et al.
2020/0395112 A1 12/2020 Ronner
2020/0401224 A1 12/2020 Cotton
2021/0074178 A1 3/2021 Ilan et al.
2021/0076981 A1 3/2021 Hacking et al.
2021/0077860 A1 3/2021 Posnack et al.
2021/0098129 A1 4/2021 Neumann
2021/0101051 A1 4/2021 Posnack et al.

(56) References Cited

U.S. PATENT DOCUMENTS

| | | | |
|---|---|---|---|
| 2021/0113890 | A1 | 4/2021 | Posnack et al. |
| 2021/0127974 | A1 | 5/2021 | Mason et al. |
| 2021/0128080 | A1 | 5/2021 | Mason et al. |
| 2021/0128255 | A1 | 5/2021 | Mason et al. |
| 2021/0128978 | A1 | 5/2021 | Gilstrom et al. |
| 2021/0134412 | A1 | 5/2021 | Guaneri et al. |
| 2021/0134425 | A1 | 5/2021 | Mason et al. |
| 2021/0134428 | A1 | 5/2021 | Mason et al. |
| 2021/0134430 | A1 | 5/2021 | Mason et al. |
| 2021/0134432 | A1 | 5/2021 | Mason et al. |
| 2021/0134456 | A1 | 5/2021 | Posnack et al. |
| 2021/0134457 | A1 | 5/2021 | Mason et al. |
| 2021/0134458 | A1 | 5/2021 | Mason et al. |
| 2021/0134463 | A1 | 5/2021 | Mason et al. |
| 2021/0138304 | A1 | 5/2021 | Mason et al. |
| 2021/0142875 | A1 | 5/2021 | Mason et al. |
| 2021/0142893 | A1 | 5/2021 | Guaneri et al. |
| 2021/0142898 | A1 | 5/2021 | Mason et al. |
| 2021/0142903 | A1 | 5/2021 | Mason et al. |
| 2021/0144074 | A1 | 5/2021 | Guaneri et al. |
| 2021/0186419 | A1 | 6/2021 | Van Ee et al. |
| 2021/0202090 | A1 | 7/2021 | DDonovan et al. |
| 2021/0202103 | A1 | 7/2021 | Bostic et al. |
| 2021/0244998 | A1 | 8/2021 | Hacking et al. |
| 2021/0345879 | A1 | 11/2021 | Mason et al. |
| 2021/0345975 | A1 | 11/2021 | Mason et al. |
| 2021/0350888 | A1 | 11/2021 | Guaneri et al. |
| 2021/0350898 | A1 | 11/2021 | Mason et al. |
| 2021/0350899 | A1 | 11/2021 | Mason et al. |
| 2021/0350901 | A1 | 11/2021 | Mason et al. |
| 2021/0350902 | A1 | 11/2021 | Mason et al. |
| 2021/0350914 | A1 | 11/2021 | Guaneri et al. |
| 2021/0350926 | A1 | 11/2021 | Mason et al. |
| 2021/0366587 | A1 | 11/2021 | Mason et al. |
| 2021/0383909 | A1 | 12/2021 | Mason et al. |
| 2021/0391091 | A1 | 12/2021 | Mason |
| 2021/0407670 | A1 | 12/2021 | Mason et al. |
| 2021/0407681 | A1 | 12/2021 | Mason et al. |
| 2022/0015838 | A1 | 1/2022 | Posnack et al. |
| 2022/0047921 | A1 | 2/2022 | Bissonnette et al. |
| 2022/0079690 | A1 | 3/2022 | Mason et al. |
| 2022/0080256 | A1 | 3/2022 | Am et al. |
| 2022/0105384 | A1 | 4/2022 | Hacking et al. |
| 2022/0105385 | A1 | 4/2022 | Hacking et al. |
| 2022/0115133 | A1 | 4/2022 | Mason et al. |
| 2022/0126169 | A1 | 4/2022 | Mason |
| 2022/0148725 | A1 | 5/2022 | Mason et al. |
| 2022/0158916 | A1 | 5/2022 | Mason et al. |
| 2022/0230729 | A1 | 7/2022 | Mason et al. |
| 2022/0238223 | A1 | 7/2022 | Mason et al. |
| 2022/0262483 | A1 | 8/2022 | Rosenberg et al. |
| 2022/0266094 | A1 | 8/2022 | Mason et al. |
| 2022/0270738 | A1 | 8/2022 | Mason et al. |
| 2022/0273986 | | 9/2022 | Mason |

FOREIGN PATENT DOCUMENTS

| | | | |
|---|---|---|---|
| CN | 202220794 | U | 5/2012 |
| CN | 103488880 | A | 1/2014 |
| CN | 104335211 | A | 2/2015 |
| CN | 105620643 | A | 6/2016 |
| CN | 105683977 | A | 6/2016 |
| CN | 105894088 | A | 8/2016 |
| CN | 105930668 | A | 9/2016 |
| CN | 106127646 | A | 11/2016 |
| CN | 106510985 | A | 3/2017 |
| CN | 107066819 | A | 8/2017 |
| CN | 107430641 | A | 12/2017 |
| CN | 107736982 | A | 2/2018 |
| CN | 108078737 | A | 5/2018 |
| CN | 208573971 | U | 3/2019 |
| CN | 110148472 | A | 8/2019 |
| CN | 110215188 | A | 9/2019 |
| CN | 111105859 | A | 5/2020 |
| CN | 111370088 | A | 7/2020 |
| CN | 112603295 | A | 4/2021 |
| DE | 95019 | C | 1/1897 |
| DE | 7628633 | U1 | 12/1977 |
| DE | 8519150 | U1 | 10/1985 |
| DE | 3732905 | A1 | 7/1988 |
| DE | 19619820 | A1 | 12/1996 |
| DE | 29620008 | U1 | 2/1997 |
| DE | 19947926 | A1 | 4/2001 |
| DE | 102018202497 | A1 | 8/2018 |
| DE | 102018211212 | A1 | 1/2019 |
| DE | 102019108425 | B3 | 8/2020 |
| EP | 199600 | A2 | 10/1986 |
| EP | 634319 | A2 | 1/1995 |
| EP | 1034817 | A1 | 9/2000 |
| EP | 2564904 | A1 | 3/2013 |
| EP | 3323473 | A1 | 5/2018 |
| EP | 3688537 | A1 | 8/2020 |
| EP | 3731733 | A1 | 11/2020 |
| FR | 2527541 | A2 | 12/1983 |
| GB | 141664 | A | 11/1920 |
| GB | 2336140 | A | 10/1999 |
| GB | 2372459 | A | 8/2002 |
| JP | 2003225875 | A | 8/2003 |
| JP | 2013515995 | A | 5/2013 |
| JP | 3198173 | U | 6/2015 |
| JP | 2019134909 | A | 8/2019 |
| JP | 6573739 | B1 | 9/2019 |
| JP | 6659831 | B2 | 3/2020 |
| JP | 6710357 | B1 | 6/2020 |
| JP | 6775757 | B1 | 10/2020 |
| JP | 2021027917 | A | 2/2021 |
| KR | 20020009724 | A | 2/2002 |
| KR | 20020065253 | A | 8/2002 |
| KR | 20150017693 | A | 2/2015 |
| KR | 20160093990 | A | 8/2016 |
| KR | 20170038837 | A | 4/2017 |
| KR | 101988167 | B1 | 6/2019 |
| KR | 20200025290 | A | 3/2020 |
| KR | 102116664 | B1 | 5/2020 |
| KR | 102116968 | B1 | 5/2020 |
| KR | 20200056233 | A | 5/2020 |
| KR | 102120828 | B1 | 6/2020 |
| KR | 102142713 | B1 | 8/2020 |
| KR | 102162522 | B1 | 10/2020 |
| KR | 102173553 | B1 | 11/2020 |
| KR | 102180079 | B1 | 11/2020 |
| KR | 102188766 | B1 | 12/2020 |
| KR | 102196793 | B1 | 12/2020 |
| KR | 20210006212 | A | 1/2021 |
| KR | 102224188 | B1 | 3/2021 |
| KR | 102224618 | B1 | 3/2021 |
| KR | 102264498 | B1 | 6/2021 |
| WO | 1998009687 | | 3/1998 |
| WO | 0151083 | A2 | 7/2001 |
| WO | 2001050387 | A1 | 7/2001 |
| WO | 2020200891 | A1 | 2/2003 |
| WO | 2003043494 | | 5/2003 |
| WO | 2006004430 | A2 | 1/2006 |
| WO | 2006012694 | A1 | 2/2006 |
| WO | 2008114291 | A1 | 9/2008 |
| WO | 2016154318 | A1 | 9/2016 |
| WO | 2018132999 | A1 | 1/2017 |
| WO | 2018171853 | A1 | 9/2018 |
| WO | 2019204876 | A1 | 4/2019 |
| WO | 2020185769 | A1 | 3/2020 |
| WO | 2020075190 | A1 | 4/2020 |
| WO | 2020130979 | A1 | 6/2020 |
| WO | 2020149815 | A2 | 7/2020 |
| WO | 2020245727 | A1 | 12/2020 |
| WO | 2020249855 | A1 | 12/2020 |
| WO | 2020252599 | A1 | 12/2020 |
| WO | 2020256577 | A1 | 12/2020 |
| WO | 2021021447 | A1 | 2/2021 |
| WO | 2021038980 | A1 | 3/2021 |
| WO | 2021055427 | A1 | 3/2021 |
| WO | 2021055491 | A1 | 3/2021 |
| WO | 2021061061 | A1 | 4/2021 |
| WO | 2021081094 | A1 | 4/2021 |
| WO | 2021138620 | A1 | 7/2021 |

(56) References Cited

FOREIGN PATENT DOCUMENTS

| | | | |
|---|---|---|---|
| WO | 2021216881 | A1 | 10/2021 |
| WO | 2021236542 | A1 | 11/2021 |
| WO | 2021236961 | A1 | 11/2021 |
| WO | 2021262809 | A1 | 12/2021 |

OTHER PUBLICATIONS

International Searching Authority, Search Report and Written Opinion for International Application No. PCT/US20/51008, dated Dec. 10, 2020, 9 pages.
International Searching Authority, Search Report and Written Opinion for International Application No. PCT/US2020/56661, dated Feb. 12, 2021, 12 pages.
International Searching Authority, Search Report and Written Opinion for International Application No. PCT/US2020/021876, dated May 28, 2020, 8 pages.
International Searching Authority, Search Report and Written Opinion for International Application No. PCT/US2021/032807, dated Sep. 6, 2021, 11 pages.
Fysiomed, "16983—Vario adjustable pedal arms", <https://www.fysiomed.com/en/products/16983-vario-adjustable-pedal-arms>, pulled from webpage on Aug. 4, 2020; 1 page.
Matrix, "R3xm Recumbent Cycle", <https://www.matrixfitness.com/en/cardio/cycles/r3xm-recumbent>, pulled from webpage on Aug. 4, 2020; 1 page.
International Searching Authority, Search Report and Written Opinion for PCT/US2020/021876, dated May 28, 2020; 8 pages.
Davenport et al., "The Potential For Artificial Intelligence in Healthcare", 2019, Future Healthcare Journal 2019, vol. 6, No. 2: Year: 2019, pp. 1-5.
Ahmed et al., "Artificial Intelligence With Multi-Functional Machine Learning Platform Development for Better Healthcare and Precision Medicine", 2020, Database (Oxford), 2020:baaa010. doi: 10.1093/database/baaa010 (Year: 2020), pp. 1-35.
Ruiz Ivan et al., "Towards a physical rehabilitation system using a telemedicine approach", Computer Methods in Biomechanics and Biomedical Engineering: Imaging & Visualization, vol. 8, No. 6, Jul. 28, 2020, pp. 671-680, XP055914810.
De Canniere Helene et al., "Wearable Monitoring and Interpretable Machine Learning Can Objectively Track Progression in Patients during Cardiac Rehabilitation", Sensors, vol. 20, No. 12, Jun. 26, 2020, XP055914617, pp. 1-15.
Boulanger Pierre et al., "A Low-cost Virtual Reality Bike for Remote Cardiac Rehabilitation", Dec. 7, 2017, Advances in Biometrics: International Conference, ICB 2007, Seoul, Korea, pp. 155-166.
Yin Chieh et al., "A Virtual Reality-Cycling Training System for Lower Limb Balance Improvement", BioMed Research International, vol. 2016, pp. 1-10.
Jennifer Bresnick, "What is the Role of Natural Language Processing in Healthcare?", pp. 1-7, published Aug. 18, 2016, retrieved on Feb. 1, 2022 from https://healthitanalytics.com/featu res/what-is-the-role-of-natural-language-processing-in-healthcare.
Alex Bellec, "Part-of-Speech tagging tutorial with the Keras Deep Learning library," pp. 1-16, published Mar. 27, 2018, retrieved on Feb. 1, 2022 from https://becominghuman.ai/part-of-speech-tagging-tutorial-with-the-keras-deep-learning-library-d7f93fa05537.
Kavita Ganesan, All you need to know about text preprocessing for NLP and Machine Learning, pp. 1-14, published Feb. 23, 2019, retrieved on Feb. 1, 2022 from https:// towardsdatascience.com/all-you-need-to-know-about-text-preprocessing-for-nlp-and-machine-learning-bcl c5765ff67.
Badreesh Shetty, "Natural Language Processing (NPL) for Machine Learning," pp. 1-13, published Nov. 24, 2018, retrieved on Feb. 1, 2022 from https://towardsdatascience. com/natural-language-processing-nlp-for-machine-learning-d44498845d5b.
Barrett et al., "Artificial intelligence supported patient self-care in chronic heart failure: a paradigm shift from reactive to predictive, preventive and personalised care," EPMA Journal (2019), pp. 445-464.
Oerkild et al., "Home-based cardiac rehabilitation is an attractive alternative to no cardiac rehabilitation for elderly patients with coronary heart disease: results from a randomised clinical trial," BMJ Open Accessible Medical Research, Nov. 22, 2012, pp. 1-9.
Bravo-Escobar et al., "Effectiveness and safety of a home-based cardiac rehabilitation programme of mixed surveillance in patients with ischemic heart disease at moderate cardiovascular risk: A randomised, controlled clinical trial," BMC Cardiovascular Disorders, 2017, pp. 1-11, vol. 17:66.
Thomas et al., "Home-Based Cardiac Rehabilitation," Circulation, 2019, pp. e69-e89, vol. 140.
Thomas et al., "Home-Based Cardiac Rehabilitation," Journal of the American College of Cardiology, Nov. 1, 2019, pp. 133-153, vol. 74.
Thomas et al., "Home-Based Cardiac Rehabilitation," HHS Public Access, Oct. 2, 2020, pp. 1-39.
Dittus et al., "Exercise-Based Oncology Rehabilitation: Leveraging the Cardiac Rehabilitation Model," Journal of Cardiopulmonary Rehabilitation and Prevention, 2015, pp. 130-139, vol. 35.
Chen et al., "Home-based cardiac rehabilitation improves quality of life, aerobic capacity, and readmission rates in patients with chronic heart failure," Medicine, 2018, pp. 1-5 vol. 97:4.
Lima de Melo Ghisi et al., "A systematic review of patient education in cardiac patients: Do they increase knowledge and promote health behavior change?," Patient Education and Counseling, 2014, pp. 1-15.
Fang et al., "Use of Outpatient Cardiac Rehabilitation Among Heart Attack Survivors—20 States and the District of Columbia, 2013 and Four States, 2015," Morbidity and Mortality Weekly Report, vol. 66, No. 33, Aug. 25, 2017, pp. 369-873.
Beene et al., "Al and Care Delivery: Emerging Opportunities For Artificial Intelligence To Transform How Care Is Delivered," Nov. 2019, American Hospital Association, pp. 1-12.
Website for "Pedal Exerciser", p. 1, retrieved on Sep. 9, 2022 from https://www.vivehealth.com/collections/physical-therapy-equipment/products/pedalexerciser.
Website for "Functional Knee Brace with ROM", p. 1, retrieved on Sep. 9, 2022 from http://medicalbrace.gr/en/product/functional-knee-brace-with-goniometer-mbtelescopicknee/.
Website for "ComfySplints Goniometer Knee", pp. 1-5, retrieved on Sep. 9, 2022 from https://www.comfysplints.com/product/knee-splints/.
Website for "BMI FlexEze Knee Corrective Orthosis (KCO)", pp. 1-4, retrieved on Sep. 9, 2022 from https://orthobmi.com/products/bmi-flexeze%C2%AE-knee-corrective-orthosis-kco.
Website for "Neoprene Knee Brace with goniometer—Patella ROM MB.4070", pp. 1-4, retrieved on Sep. 9, 2022 from https://www.fortuna.com.gr/en/product/neoprene-knee-brace-with-goniometer-patella-rom-mb-4070/.
Kuiken et al., "Computerized Biofeedback Knee Goniometer: Acceptance and Effect on Exercise Behavior in Post-total Knee Arthroplasty Rehabilitation," Biomedical Engineering Faculty Research and Publications, 2004, pp. 1-10.
Ahmed et al., "Artificial intelligence with multi-functional machine learning platform development for better healthcare and precision medicine," Database, 2020, pp. 1-35.
Davenport et al., "The potential for artificial intelligence in healthcare," Digital Technology, Future Healthcare Journal, 2019, pp. 1-5, vol. 6, No. 2.
Website for "OxeFit XS1", pp. 1-3, retrieved on Sep. 9, 2022 from https://www.oxefit.com/xs1.
Website for "Preva Mobile", pp. 1-6, retrieved on Sep. 9, 2022 from https://www.precor.com/en-us/resources/introducing-preva-mobile.
Website for "J-Bike", pp. 1-3, retrieved on Sep. 9, 2022 from https://www.magneticdays.com/en/cycling-for-physical-rehabilitation.
Website for "Excy", pp. 1-12, retrieved on Sep. 9, 2022 from https://excy.com/portable-exercise-rehabilitation-excy-xcs-pro/.

(56) References Cited

OTHER PUBLICATIONS

Website for "OxeFit XP1", p. 1, retrieved on Sep. 9, 2022 from https://www.oxefit.com/xp1.

* cited by examiner

SYSTEM, METHOD AND APPARATUS FOR A REHABILITATION MACHINE WITH A SIMULATED FLYWHEEL

CROSS-REFERENCE TO RELATED APPLICATIONS

This application claims priority to and the benefit of U.S. Prov. Pat. App. No. 62/816,557, filed on Mar. 11, 2019, and U.S. Prov. Pat. App. No. 62/816,550, filed Mar. 11, 2019, each of which is incorporated herein by reference in its entirety.

TECHNICAL FIELD

The present disclosure relates generally to an exercise machine or a rehabilitation machine with a simulated flywheel.

BACKGROUND

Improvement is desired in the construction of adjustable rehabilitation and exercise devices. Adjustable rehabilitation and exercise devices allow customization of rehabilitation and exercise for an individual. Some devices include pedals on opposite sides to engage a user. See, e.g., U.S. Pat. No. 10,173,094, titled Adjustable Rehabilitation and Exercise Device, issued to Gomberg, et al., which is hereby incorporated by reference in its entirety. Stationary exercise machines typically have high mass flywheels to simulate the inertial force of riding a bicycle. However, such high mass flywheels can be difficult to adjust and increase material and shipping costs for the exercise machines.

Accordingly an exercise or rehabilitation machine having a simulated flywheel is provided.

SUMMARY

In general, the present disclosure provides example embodiments of a pedal or pedal system to be engaged by a user to provide exercise or rehabilitation.

In one aspect, an electromechanical device for exercise and rehabilitation is disclosed. The electromechanical device includes one or more pedals coupled to one or more radially-adjustable couplings connected in turn to an axle. The pedals include one or more sensors to measure pedal force applied to the pedals. The electromechanical device further includes a pulley fixed to the axle, with the axle defining a rotational axis for the pedals. The electromechanical device further includes an electric motor coupled to the pulley to provide a driving force to the pedals via the pulley. The electromechanical device further includes a control system that includes one or more processing devices operably coupled to the electric motor to simulate a flywheel. The processing devices are configured to receive a sensed-force value applied to the pedals by a user. The processing devices are further configured to determine a pedal rotational position. The processing devices are further configured to determine a rotational velocity of the pedals. The processing devices are further configured to, based on the sensed-force value and the pedal rotational position, detect a pedaling phase. The processing devices are further configured to, if the pedaling phase is not in a coasting phase and the sensed-force value is in a set range, maintain a current driving force of the electric motor to simulate a desired inertia on the pedals. The processing devices are further configured to, if the pedaling phase is in the coasting phase and the rotational velocity has not decreased, decrease the driving force of the electric motor and maintain a decreasing inertia on the pedals. The processing devices are further configured to, if the pedaling phase is not in the coasting phase and the rotational velocity has decreased, increase the driving force of the electric motor to maintain a desired rotational velocity.

In another aspect, an electromechanical device for exercise and rehabilitation is disclosed. The electromechanical device includes one or more pedals coupled to one or more radially-adjustable couplings connected in turn to an axle. The electromechanical device further includes one or more force sensors on the pedals to sense pedal force applied to the pedals by a user. The electromechanical device further includes a wheel fixed to the axle and defining a rotational axis for the pedals. The electromechanical device further includes an electric motor coupled to the wheel to provide a driving force to the pedals via the wheel and the radially-adjustable couplings. The electromechanical device further includes a control system including one or more processing devices operably coupled to the electric motor to simulate a flywheel. The processing devices are configured to receive a sensed-force value representing a pedal force applied onto the pedals by the user. The processing devices are further configured to, if the sensed-force value is in a desired range, maintain the driving force at a present drive state. The processing devices are further configured to, if the sensed-force value is above the desired range, decrease the driving force to the pedals. The processing devices are further configured to, if the sensed-force value is below the desired range, increase the driving force to the pedals.

In yet another aspect, a method of electromechanical rehabilitation is disclosed. The method includes receiving a pedal force value from a pedal sensor of a pedal. The method further includes receiving a pedal rotational position. The method further includes, based on the pedal rotational position over a period of time, calculating a pedal velocity. The method further includes, based at least upon the pedal force value, a set pedal resistance value, and the pedal velocity, outputting one or more control signals causing an electric motor to provide a driving force to control simulated rotational inertia applied to the pedal.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The term "couple" and its derivatives refer to any direct or indirect communication between two or more elements, independent of whether those elements are in physical contact with one another. The terms "transmit," "receive," and "communicate," as well as derivatives thereof, encompass both direct and indirect communication. The terms "transmit," "receive," and "communicate," as well as derivatives thereof, encompass both communication with remote systems and communication within a system, including reading and writing to different portions of a memory device. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system (e.g., control system), or part thereof that controls at least one operation. Such a controller may be implemented in hardware or a combination of hardware, software, or firmware. Such a controller may include one or more processing devices. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A; B; C; A and B; A and C; B and C; and A, B, and C.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a flash drive, a compact disc (CD), a digital video disc (DVD), solid state drive (SSD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom," and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

In general, the present disclosure provides example embodiments of an exercise/rehabilitation system using pedals and an electric motor responsive to control signals to simulate a flywheel. The control signals can be produced according to a program, which in some example embodiments receives position or force signals from the pedal itself. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the present disclosure. In some example embodiments, well-known processes, well-known device structures, and well-known technologies are not described in detail, as they will be readily understood by the skilled artisan in view of the disclosure herein.

The electric motor in the present system can control the force at the pedals. This will allow a rehabilitation medical professional to determine the force that a user-patient can apply to the pedals. Thus, a user can engage in range of motion rehabilitation exercises before the user has the strength to begin to rotate the simulated flywheel. This allows the rehabilitation/exercise system to be lightweight and free of a flywheel, resulting in a significant reduction of mass relative to the entire system.

FIGS. 1-9, discussed below, and the various embodiments used to describe the principles of this disclosure are by way of illustration only and should not be construed in any way to limit the scope of the disclosure.

Figure 1:
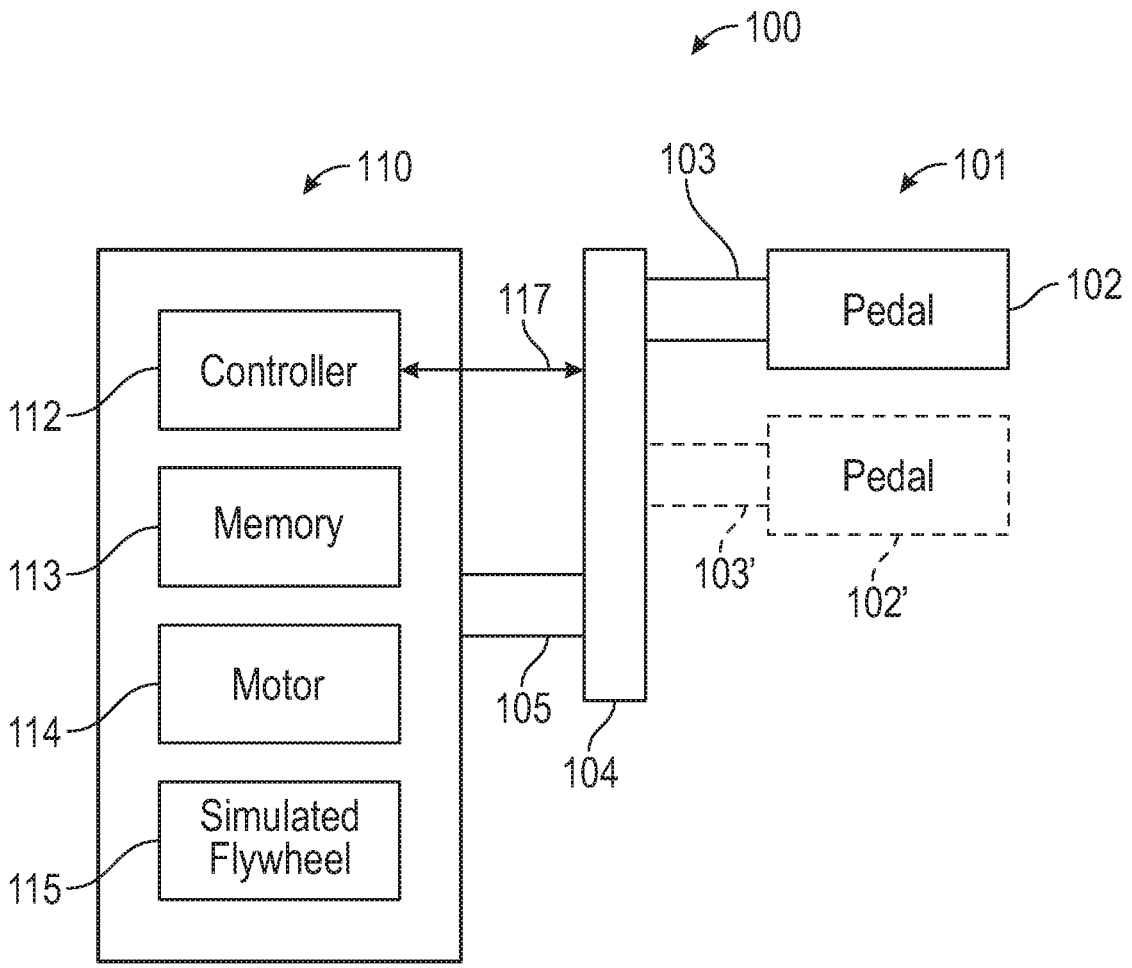
FIG. 1 is a schematic view of an exercise machine with an actuatable pedal in accordance with the present disclosure.

FIG. 1 shows a schematic view of a rehabilitation system 100 that includes a pedal system 101 operably engaged with a base 110, in accordance with the present disclosure. The pedal system 101 includes an engagement member, e.g., a pedal 102, to engage a user with the rehabilitation system. The pedal 102 is configured for interacting with a patient to be rehabilitated and may be configured for use with lower body extremities such as the feet or legs, or upper body extremities such as the hands or arms, or any other suitable body parts. The pedal 102 is positioned on a spindle 103 that is supported on a pedal arm assembly 104. The pedal 102 can be pivotably mounted on the spindle 103. The pedal arm assembly 104 is connected to the axle 105 of the base 110, which supports and, at times, drives the axle 105. A controller 112 is electrically connected to the pedal arm assembly 104 to provide a control signal to control operation of the pedal arm assembly 104. The pedal arm assembly 104 can be coupled to the axle 105 of the rehabilitation or exercise machine with the axle being radially offset from the axis of the spindle 103 to define a range of radial travel of the pedal 102 relative to the axle 105. As shown in FIG. 1, the pedal 102 can be moved from a first position (solid line) to a second position as illustrated by pedal 102' (broken line). The spindle 103 is moved by the pedal arm assembly relative to the fixed axle 105 from the first position (solid line, 103) and a second position (broken line, 103'). The pedal arm assembly 104 is electrically actuatable by a control signal 117 from the controller 112. The pedal arm assembly 104 adjusts a radial position of the pedal 102, e.g., from the solid line position to the broken line position or vice versa, or to any position in between, relative to the axle. In an embodiment with two pedals, one for the left foot and one for the right, each pedal can be individually controlled by the controller 112. The pedal 102 (solid line) is positioned radially outwardly from the pedal 102' (broken line). The pedal 102 will have a larger travel path than the pedal 102' as they rotate around the axle 105. The base 110 includes an electric motor 114 for providing a driving force or resistance to the pedal 102 and for providing a simulated flywheel 115.

FIGS. 2A, 2B, 2C and 2D show the pedal 102 in a perspective view, a side view, a rear end view, and a top view, respectively. The pedal 102 includes a pedal bottom cover 201 and a pedal frame 203 on the pedal bottom cover 201. The pedal frame 203 can be rigid and define a throughbore 205 to receive the spindle 103. The spindle 103 can be fixed longitudinally in the throughbore 205 while allowing the pedal frame 203 to pivot on the spindle 103. The spindle 103 extends out of one end of the throughbore 205 and the other end of the throughbore 205 can be covered by a cap 206. A pedal top 207 is joined on the top of the pedal frame 203 and is configured to receive a foot of a user. The pedal top 207 may include treads to grip a user's shoe tread or foot directly. The pedal top 207 can include a lip 209 around the periphery with a heel portion being taller than the other parts of the lip. The lip 209 assists in preventing the user's foot from sliding off the pedal top 207. The pedal top 207 is moveably mounted to pedal frame 203 to transfer a force applied onto the pedal top 207 to one or more force sensors that are in the pedal 200.

Figure 2A:
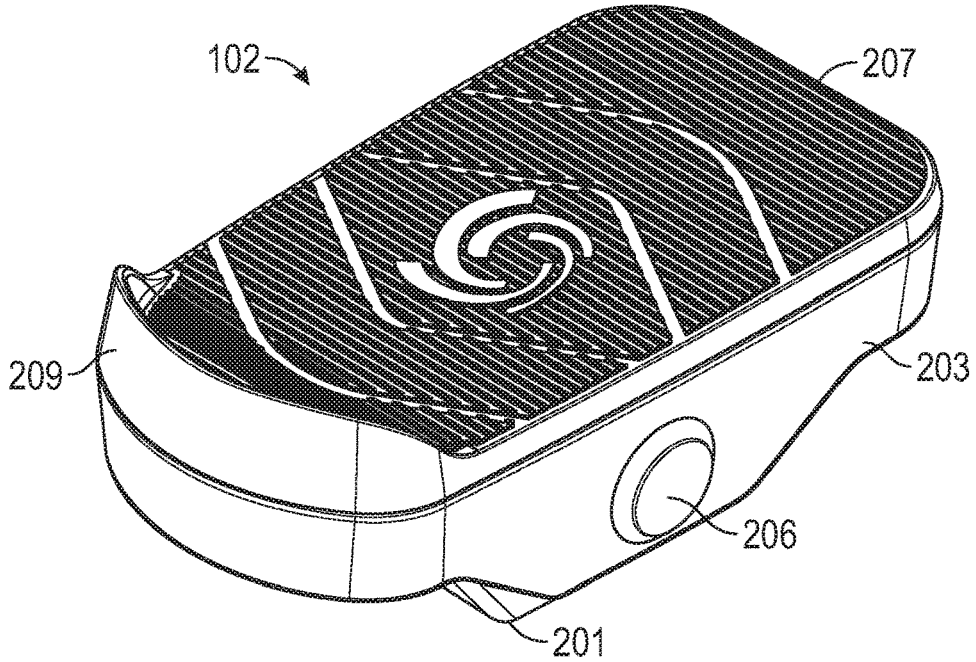
FIGS. 2A-2E are views of the pedal in accordance with the present disclosure.
Figure 2B:
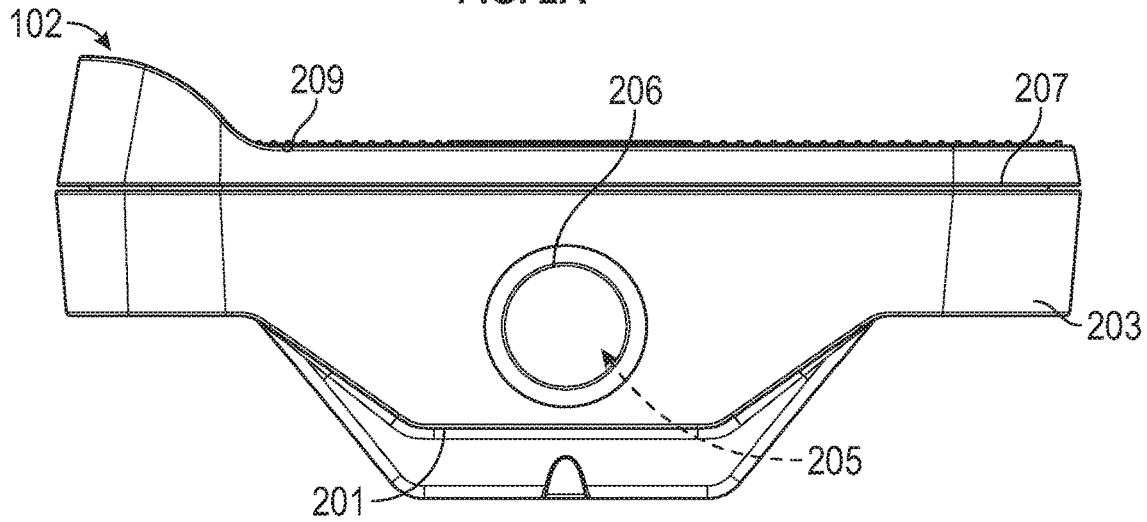
Figure 2C:
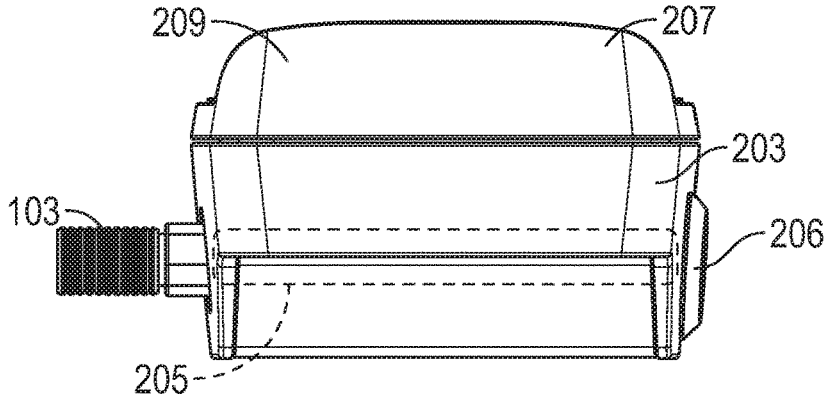
Figure 2D:
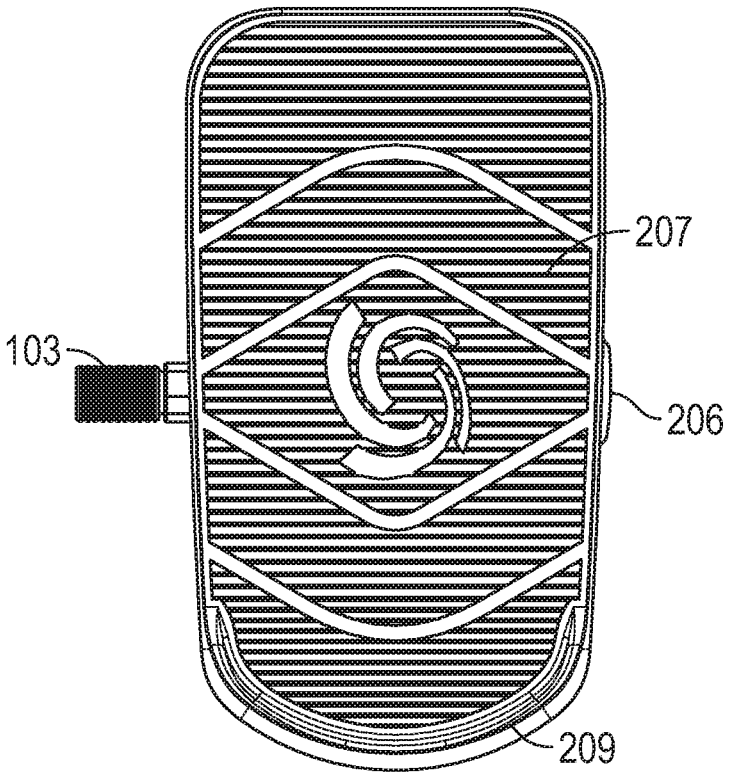
Figure 2E:
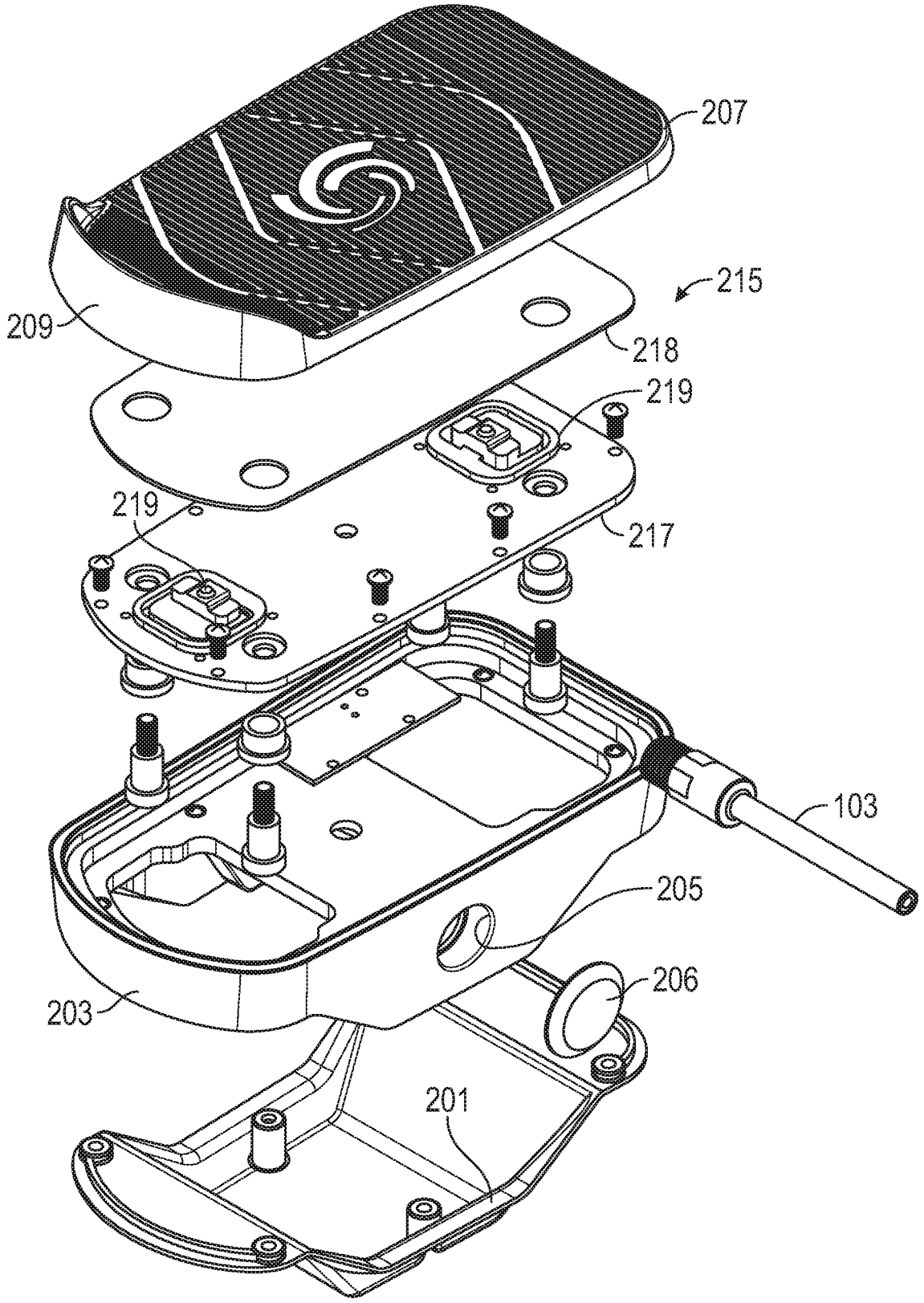

FIG. 2E is an exploded view of the pedal 102 to illustrate the structure to sense force applied to the pedal during exercise or rehabilitation. A sensor assembly 215 is mounted within the pedal 102. The sensor assembly 215 includes base plate 217, a top plate 218 above the base plate 217, and one or more force sensors 219 (e.g., a heel sensor located at a heel end of the pedal or a toe sensor located at a toe end of the pedal) between the plates 217, 218. The one or more force sensors 219 sense the force applied to the pedal and output a sensor value that represents force applied to the pedal. The sensor value may go to the controller 112 (FIG. 1). The sensors can output a wireless signal representing the sensed-force or can output a wired signal (e.g., through the spindle 103). The base plate 217 is fixed within an upper recess in the pedal frame 203. One or more force sensors 219 are fixed to the top surface of the base plate 217 or a bottom surface of the top plate 218. In an example, one force sensor is positioned on base plate 217. In the illustrated example, the heel sensor is positioned at the heel end of the base plate 217 and the toe sensor is positioned at the toe end of the base plate 217. When a plurality of sensors is used, the sensor assembly 215 can include processor circuitry and memory operably coupled thereto to perform calculations on sensed-force signals from all of the force sensors 219 and output a calculated force signal from the pedal 102. The force sensors 219 can be strain gauges, (e.g., foil strain gauge, which changes electrical resistance when it is deformed, and the electrical resistance can be determined by a Wheatstone bridge). The strain gauge can be a piezoresistor, microelectromechanical system (MEMS), variable capacitors, or other sensors that output a signal when a force is applied thereto. The base plate 217 and the top plate 218 move relative to each other such that the force moving at least one of the plates 217, 218 is applied to one of the force sensors 219. In an example embodiment, the plates 217, 218 travel less than 2 mm, 1 mm, or 0.5 mm relative to each other and any movement applies a force to the force sensors 219. In operation, the user will apply a force to the pedal top 207. This force will cause the pedal 102 to rotate in a travel path defined by the position of the spindle 103 relative to the axle 105. There can be some resistance, inertial or applied, as described herein. The resistance to pedal rotation must be overcome by the application of force by the user. This force is transmitted through the pedal top 207 to the force sensors 219, which output a measurement value representing this force.

Figure 3A:
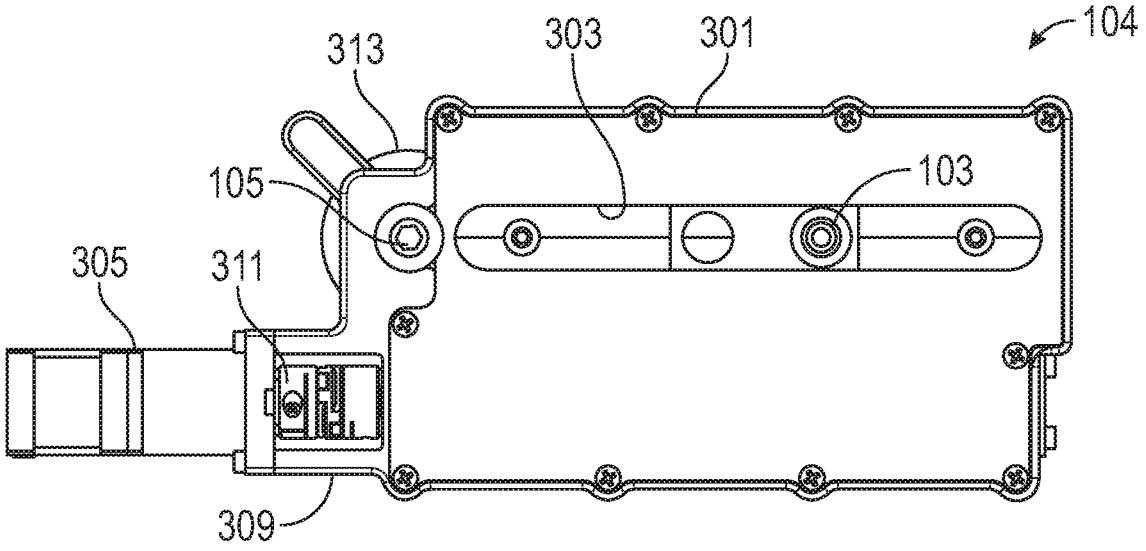
FIGS. 3A-3C are views of the pedal control assembly in accordance with the present disclosure.
Figure 3B:
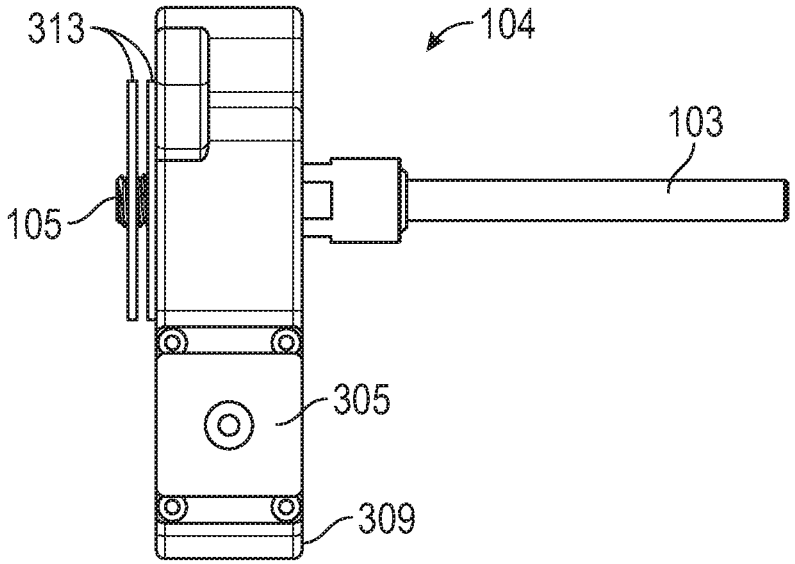

FIGS. 3A and 3B are a side view and an end view of the pedal arm assembly 104, respectively. The pedal arm assembly 104 includes a housing 301 with an aperture 303 through which the spindle 103 extends. The aperture 303 defines the linear travel of the spindle 103 (and, hence, the pedal 102) relative to the fixed axle 105. A carriage 304 is in the housing 301 aligned with the aperture 303. The carriage 304 supports the spindle 103 for travel orthogonal to the aperture 303. An electric motor 305 is fixed at an end of the housing 301 and is fixed by a motor mount 307 to a housing hub 309 of the housing 301. A slip ring 313 provides an electrical communication path between the electric motor 305 and the controller 112.

Figure 3C:
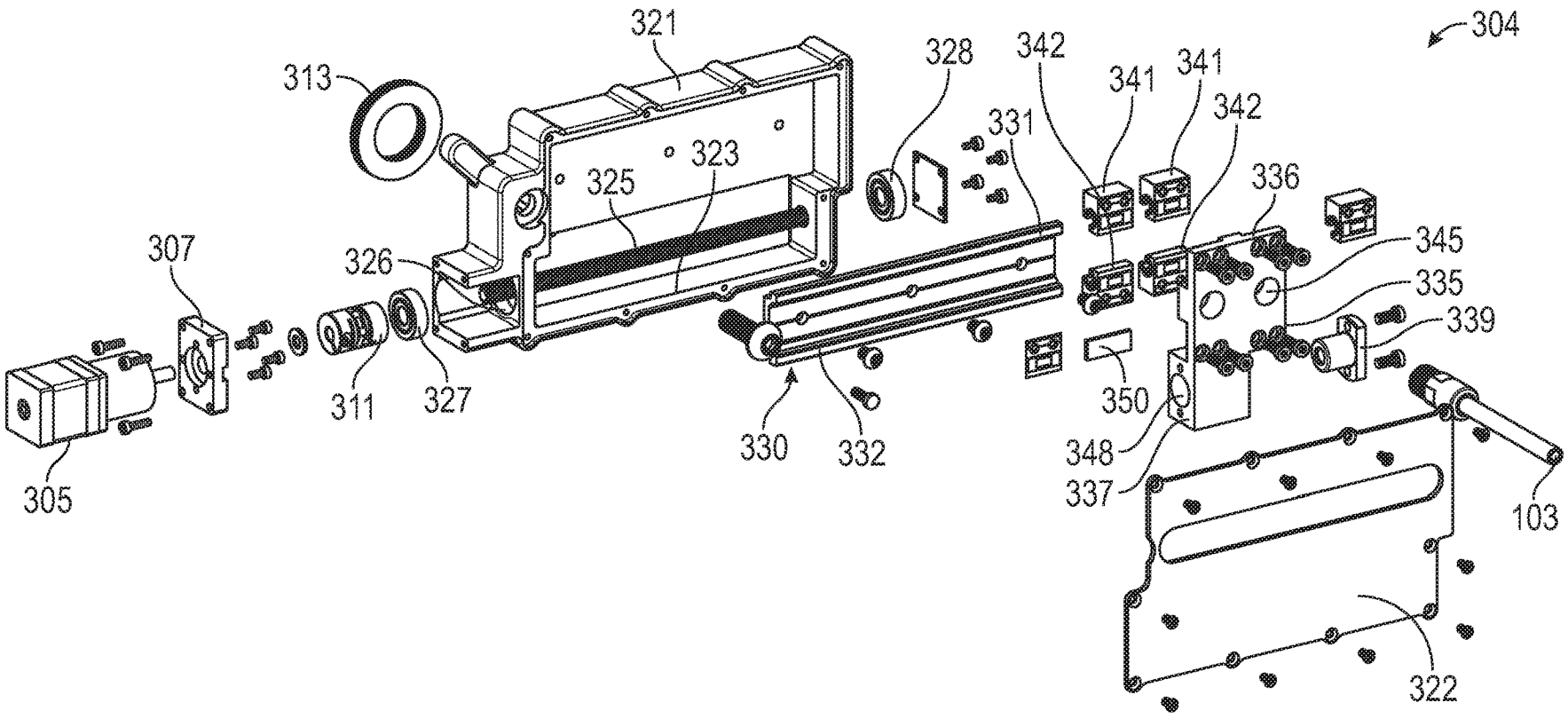

FIG. 3C is an exploded view of the pedal arm assembly 104. A shaft coupler 311 connects the drive of the electric motor 305 to a drivescrew 325 mounted inside the housing 301. The drivescrew 325 is elongate and extends through drivescrew holes 326 positioned near the bottom of the housing 301. Bearings 327, 328 fixed in the drivescrew holes 326 support the drivescrew 325 for rotation. The drivescrew 325 is threaded at least between the bearings 327, 328. The drivescrew 325 can be threaded its entire length. The drivescrew 325 can be rotated in either a clockwise direction or a counterclockwise direction by the electric motor 305.

A rail 330 is fixed in the housing 321 above the drivescrew 325. The rail 330 is elongate and defines a travel path of the spindle 103. The rail 330 includes a top guide edge 331 at the top of the rail and a bottom guide edge 332 at the bottom of the rail.

The carriage 304 includes a top member 336 configured to mechanically engage the rail 330 to guide the carriage 304 along the longitudinal length of the rail 330. The carriage 304 includes a bottom member 337 to engage the drivescrew 325 to provide the motive force to move the carriage in the housing 321. The top member 336 is fixed to the bottom member 337. In an example embodiment, the top member 336 and bottom member 337 are formed from a unitary block of a rigid material (e.g., a metal or rigid polymer). A plurality of upper bearing blocks 341 fixed to the top member 336 is slidably engaged on the top guide edge 331. A plurality of lower bearing blocks 342 fixed to the top member 336, below the upper bearing blocks 341, is slidably engaged on the bottom guide edge 332. The bottom member 337 includes a throughbore 348 to receive the drivescrew 325. In an example embodiment, the throughbore 348 is threaded to engage threads of the drivescrew 325. In the illustrated example, a carriage coupling 339 is fixed to the bottom member 337 at the throughbore 348. The carriage coupling 339 is internally threaded to mate with the external threads of the drivescrew 325. In operation, the electric motor 305 turns the drivescrew 325, and the carriage 304 through the carriage coupling 339 translates the rotational motion of the drivescrew to linear movement of the carriage 304 on the rail 330.

The carriage 304 includes a spindle engagement 345 to fix the spindle 103 thereto. The spindle engagement 345 can include a threaded recess to receive a threaded carriage end of the spindle 103.

A cover plate 322 is provided on the housing 321 to cover the recesses 323 receiving the internal components. The cover plate 322 includes the aperture 303 through which the spindle extends. The aperture 303 and the spindle engagement 345 are aligned to allow the spindle 103 to travel on the carriage 304 in the aperture 303.

A slide plate 350 is provided on the bottom member 337. The slide plate 350 slidably engages the housing (e.g., laterally adjacent the drivescrew 325) to assist in preventing rotation of the carriage 304 in the housing.

Figure 4A:
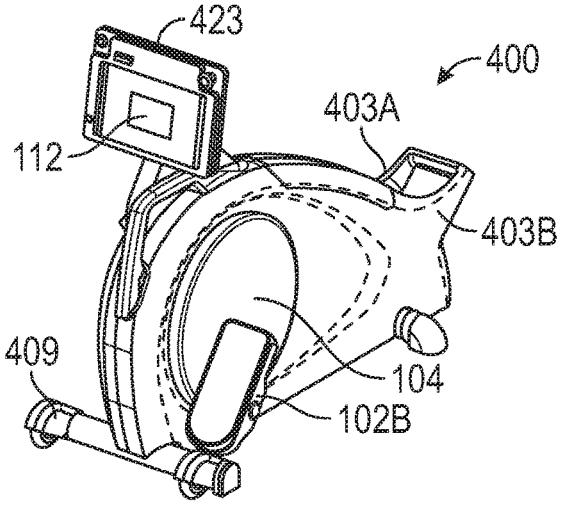
FIGS. 4A-4D are views of the rehabilitation/exercise system in accordance with the present disclosure.
Figure 4B:
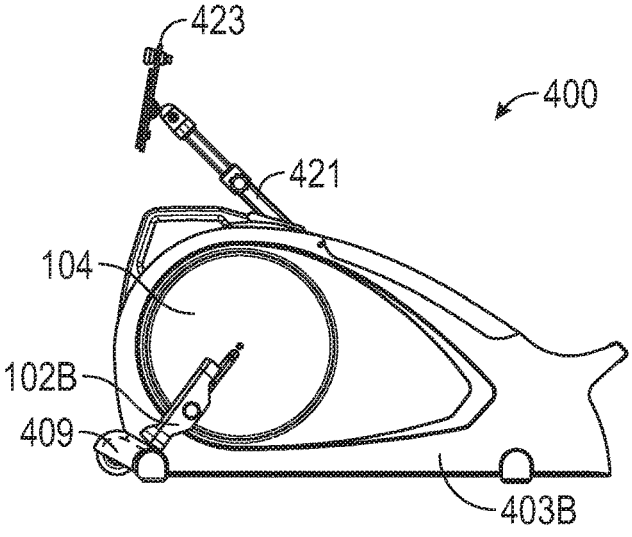
Figure 4C:
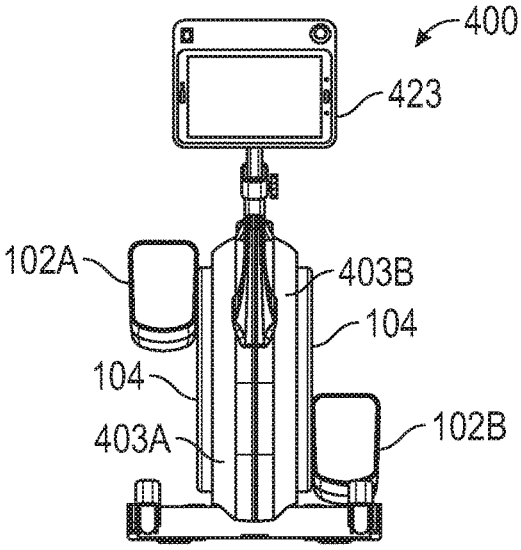
Figure 4D:
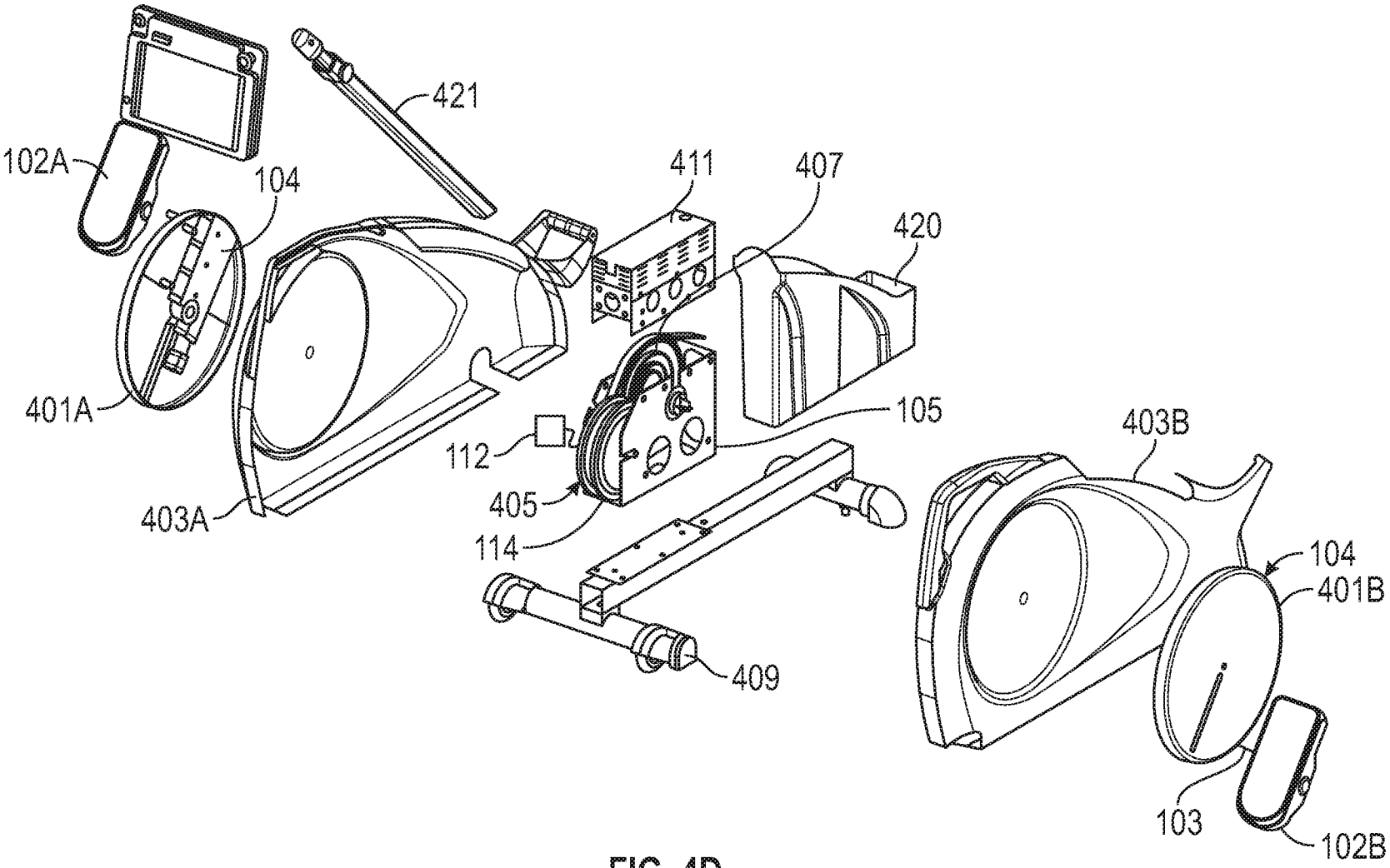

FIGS. 4A, 4B, and 4C are a perspective view, a side view and a rear view, respectively, of an exercise or rehabilitation electromechanical system 400 that uses the pedal and pedal arm assembly (102, 104) described herein. FIG. 4D is an exploded view of the exercise or rehabilitation electromechanical device 400. The electromechanical system 400 includes one or more pedals that couple to one or more radially-adjustable couplings. The electromechanical system 400 includes a left pedal 102A that couples to a left radially-adjustable coupling assembly 104 via a spindle 103 through a shroud 401. The radially-adjustable coupling 124 and shroud 401 can be disposed in a circular opening of a left outer cover 403 and the pedal arm assembly 104 can be secured to a drive sub-assembly 405. The drive sub-assembly 405 may include the electric motor 114 that is operably coupled to the controller 112. The drive sub-assembly 405 may include one or more braking mechanisms, such as disc brakes, which enable instantaneously locking the electric motor 114 or stopping the electric motor 114 over a period of time. The electric motor 114 may be any suitable electric motor (e.g., a crystallite electric motor). The electric motor 114 may drive the axle 105 directly. In the illustrated example, the motor connects to a central pulley 407 that is fixed to the axle 105. The central pulley 407 can be connected to the drive axle of the electric motor 114 by a belt or chain or can be directly connected to the electric motor 114. The central pulley 407 can be a lightweight polymer wheel having apertures therein to save weight. The central pulley 407 is lightweight such that it does not provide any significant inertial energy that resists movement of the pedals 102 in use. The drive sub-assembly 405 can be secured to a frame sub-assembly 409, which includes a main support spine and legs extending outwardly therefrom. One set of legs may include wheels to move the system. A top support sub-assembly 411 may be secured on top of the drive sub-assembly 405 to essentially enclose the electric motor 114 and the central pulley 407. A right pedal 102B couples to a right radially-adjustable coupling 401B via a right pedal arm assembly 104 disposed within a cavity of the right radially-adjustable coupling 401B. The right pedal 102B is supported in the same manner as the left pedal 102A, but on the other side and 180 degrees out of phase with the left pedal 102A. An internal volume may be defined when the left outer cover 403A and the right outer cover 403B are secured together around the frame sub-assembly 409. The left outer cover 403A and the right outer cover 403B may also make up the frame of the system 400 when secured together. The drive sub-assembly 405, top support sub-assembly 411, and pedal arm assemblies 104 may be disposed within the internal volume upon assembly. A storage compartment 420 may be secured to the frame sub-assembly 409 to enclose the drive sub-assembly 405 and top support sub-assembly 411.

Further, a computing device arm assembly 421 may be secured to the frame and a computing device mount assembly 422 may be secured to an end of the computing device arm assembly 421. A computing device 423 (e.g., controller 112) may be attached or detached from the computing device mount assembly 421 as desired during operation of the system 400.

Figure 5:
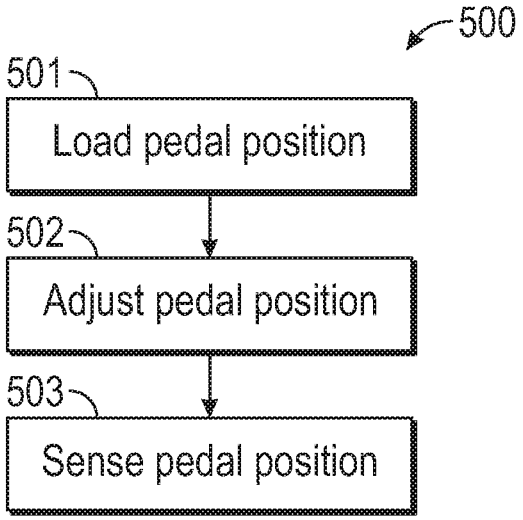
FIG. 5 is a flowchart of a method for operating the rehabilitation/exercise system in accordance with the present disclosure.

FIG. 5 is a flowchart of a method 500 for controlling the pedal position. At 501, a pedal position is loaded into the controller 112 or memory 113. The pedal position can be entered via a user interface through an I/O on the base 110. The user interface can present a treatment plan (e.g., for rehabilitation or exercise) for a user according to certain embodiments of this disclosure. The user interface can be at the base or at a remote device in communication with the base. The treatment plan can be set by a user (e.g., a physician, nurse, physical therapist, patient, or any other suitable user). The pedal position can be part of an individualized treatment plan taking into account the condition of the user (e.g., recovery after a surgery, knee surgery, joint replacement, a muscle conditions or any other suitable condition).

At 502, the radial position of a pedal relative to the axle is electrically adjusted in response to a control signal output by the controller 112 to control the electric motor 305 to position the carriage 304, and hence the pedal 102, through the spindle 103. In an example embodiment, the electric motor 305 is connected to the carriage 304 through a linkage (e.g., the drivescrew 325 to linearly move the spindle 103). In an example embodiment, the radial position of the pedal is adjusted, during a revolution of the pedal, to produce an elliptical pedal path relative to the axle. The radial position of the pedal can be adjusted in response to the control signal during a user pedaling the pedal.

At 503, the rotational motion of the user engaged with the pedal is controlled. The controller can control the position of the pedal 103 in real time according to the treatment plan. The position of a right pedal can be different than that of the left pedal. The pedal can also change position during the use. The pedal can also sense the force a user is applying to the pedal. A force value can be sent from the pedal to the controller, which can be remote from the pedal.

At 504, the rotational position of the pedal is sensed. The rotational position of the pedal can provide information regarding the use, e.g., to control radial position of the pedal, the rotational motion (e.g., speed, velocity, acceleration, etc.) and the like.

Figure 6:
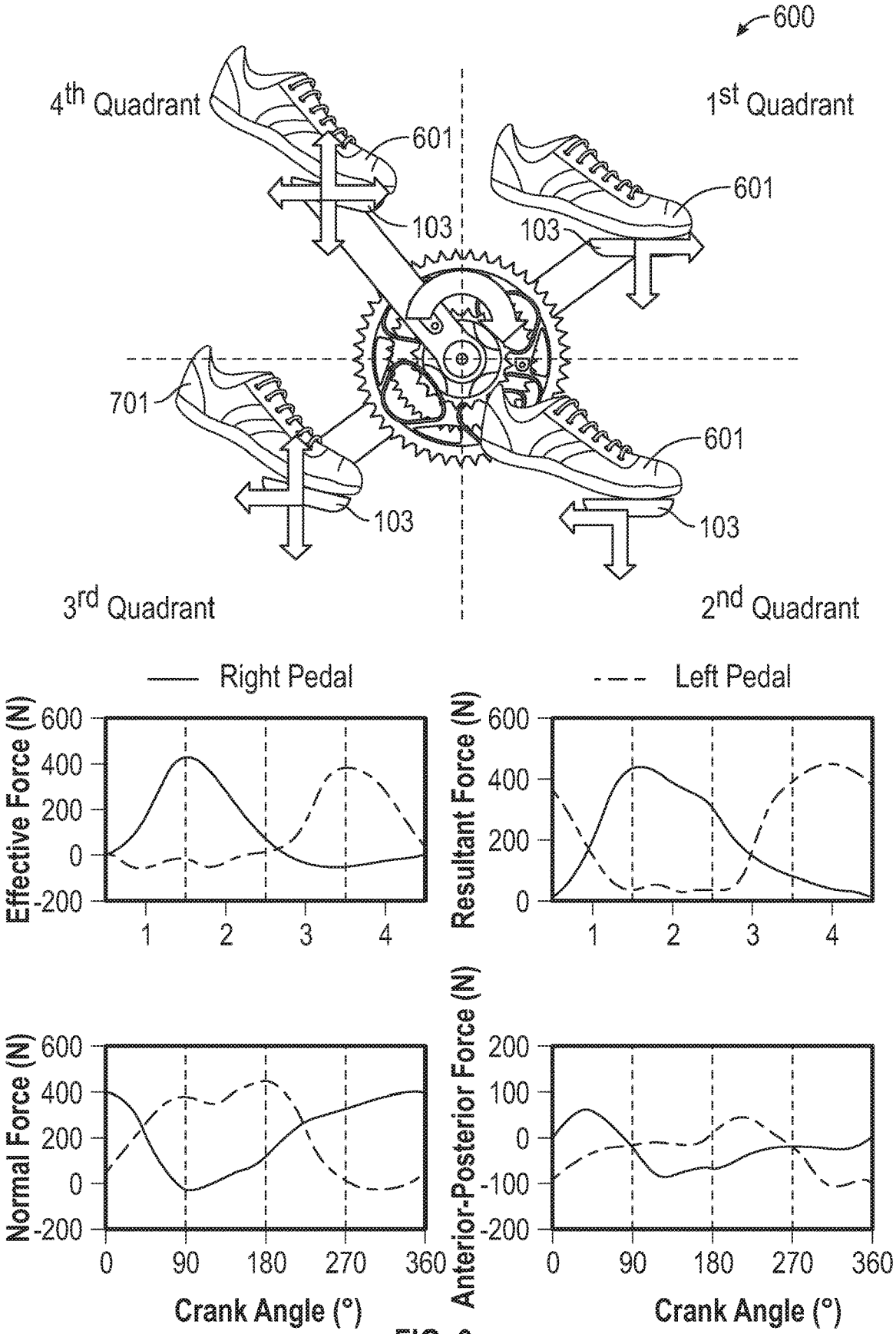
FIG. 6 is a schematic view of a pedal and resulting forces in accordance with the present disclosure.

FIG. 6 is a schematic view 600 of a pedal 103 and resultant force vectors. The pedal 103 will experience greater applied force from the foot 601 (represented by the shoe) in the first quadrant and the second quadrant (i.e., when driving the pedal down). There will be the less applied force in the third quadrant and fourth quadrants. When pedaling a bicycle with forward motion and inertial energy, or a stationary bike with a heavy flywheel, e.g., greater than twenty pounds, the user experiences inertial force that affects the feel experienced by the user. In an example embodiment, the drive components (e.g., the electric motor, the pulley, the pedal connector assembly, and the pedals) all have a mass of less than 10 kilograms. The inertial force can be felt when there is a reduced applied force, e.g., when both pedals are not applying a force. A heavily weighted flywheel will continue the force felt by the user (e.g., greater than 15 kg, greater than 20 kg, or more). However, an example embodiment of the present disclosure does not have a heavy flywheel. In this case, the electric motor must be controlled to simulate a flywheel and the inertia of the flywheel, which can be felt by a user, such that the electric motor controls a resistance to travel of the pedals. If the electric motor did not provide increased force to the pedal, then the pedal would slow a greater amount. If the electric motor did not provide a resistance to the force applied by the user to the pedal, the user could not apply a sufficient force to the pedal. Thus, the control system simulates the flywheel by controlling the electric motor to drive the pulley when the one or more pedals are not rotating within a desired range. Controlling the electric motor 114 to simulate a flywheel can assist in keeping the user compliant with the treatment plan on the rehabilitation system 100.

Figure 7:
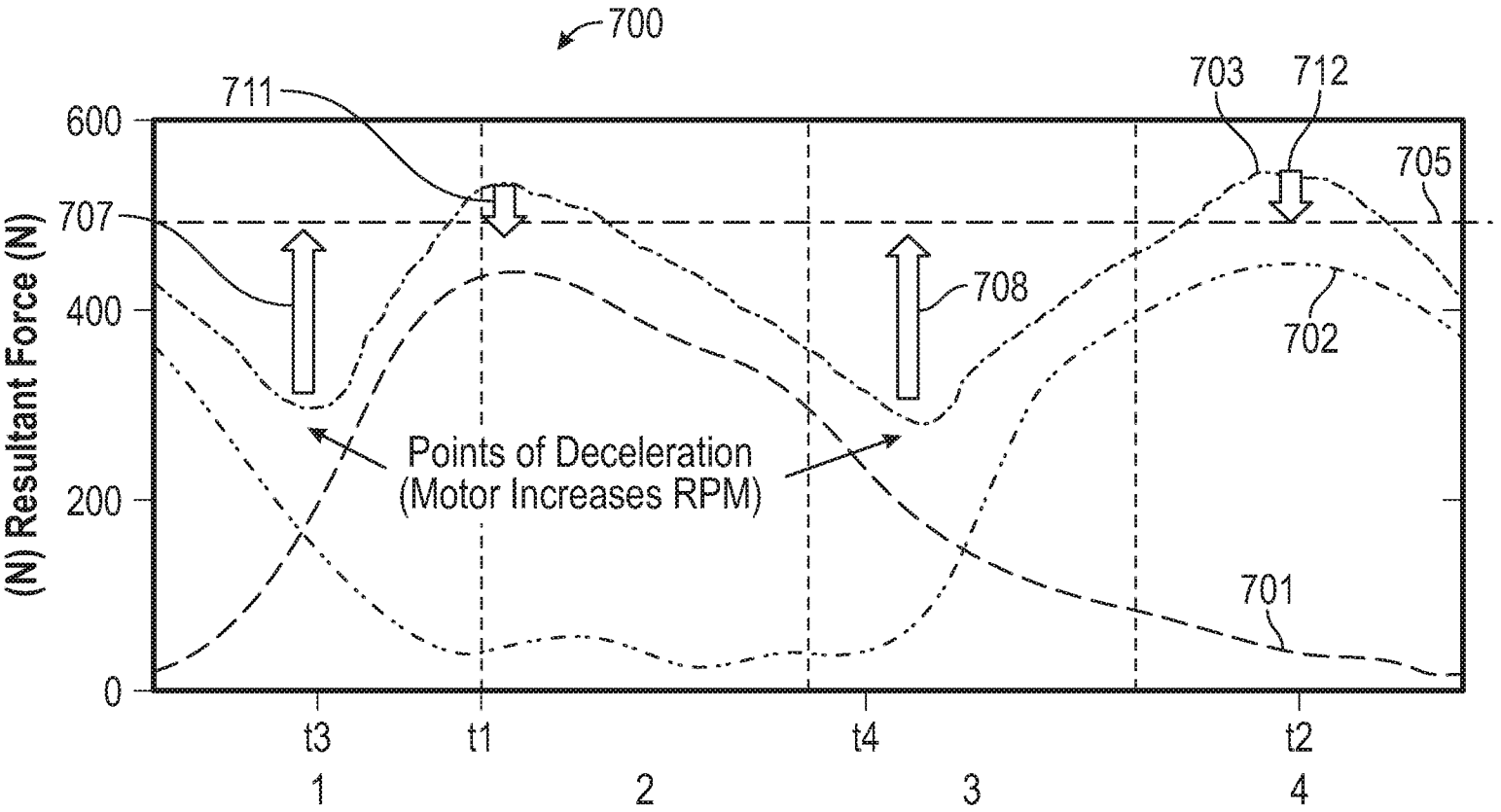
FIG. 7 is a graph showing the points at which the motor can maintain a set resultant force in accordance with the present disclosure.

FIG. 7 shows a graph 700 of pedaling forces from pedaling and a simulated flywheel from the electric motor 114. The applied force at the right pedal 701 peaks at time t1 essentially between quadrant 1 and 2. The quadrants are defined relative to the right pedal. The applied force at the left pedal 702 peaks at time t2 in quadrant 4. The sum of the applied forces of both the right pedal and the left pedal is shown at 703. At 705, there is shown the desired steady force that a user experiences with a flywheel. The desired level of force can be changed according to the rehabilitation regimen prescribed to the user, which can be stored in memory and used by a controller. In the illustrated example of FIG. 7, the force is set at about 500N. It is desired, in some embodiments of the present disclosure, to simulate a flywheel by driving the electric motor 114 when the sum of forces 703 fall below the desired level of force 705. At time t3, the electric motor 114 must drive the pedals to accelerate the pedals so that the force at the pedals is at the desired level of force 705. The same occurs at time t4. The force applied by the electric motor 114 is schematically shown at 707, 708. At times t3, t4, the pedals are not receiving enough force from the user and the rotational speed will drop. The electric motor 114 applies an acceleration to keep the force essentially the same, i.e., by Newton's second law, F=m*a. In the present system 100, the mass is quite low so that the system is portable. Accordingly, the change in acceleration will have an effect on the force perceived by the user at the pedals as the mass of the drive components in the present rehabilitation system is low. At times t1 and t2, the force at the pedals is at its highest and is above the desired level of force 705. Here, the electric motor 114 will drop the force at the pedals. While there will be some variation from the desired level of force due to the forces applied to the pedals at different quadrants and positions of the pedals in the travel path, the force can be held in a range around the set value at 705.

Figure 8:
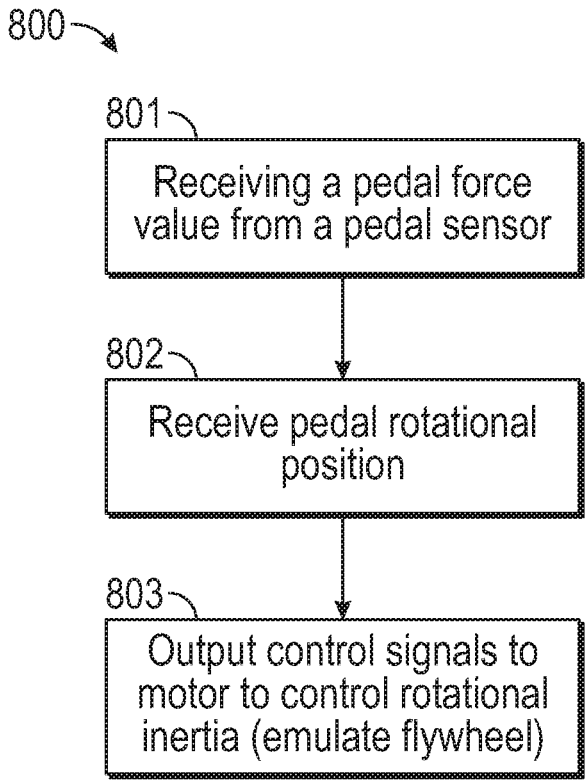
FIG. 8 is a flowchart of a method for operating the rehabilitation/exercise system in accordance with the present disclosure.

FIG. 8 is a method 800 of electromechanical rehabilitation using a simulated flywheel. At 801, a pedal force value is received from the pedal sensor to indicate the force being applied to the pedal by the user when pressing on the pedal. The pedal force can be sensed using a single sensor at each pedal. In an example embodiment, the pedal force value can be a statistically or mathematically computed value from a plurality of pedal sensors. The pedal force value, or total force, can be computed from a toe end force received as a toe signal from a toe sensor at the toe end of the pedal and a heel end force received as a heel signal from a heel sensor at a heel end of the pedal. The pedal force value can be the sum of the toe end force and the heel end force. The pedal force value can be received at the controller 112 or the computing device 423. The pedal force value can be transmitted over a physical connection, e.g., through the slip rings and over wires connected to the controller. The pedal force value can be wirelessly sent over a near field communication (e.g., using Bluetooth™ standard) from the sensor in the pedal to a remote receiver in base 110 or computing device 423.

As noted, power transmission to the motor on the pedal arm may be conducted via slip rings. Other embodiments can include a wireless power transmission system that can use transformer coils (such as thin pairs of them) on the main unit and the pedal arm. DC voltage can be wirelessly passed to the pedal arm to charge onboard battery pack(s). The controller can split the charge to left and right controllers for the respective pedal arms. The motor control of the pedal arms can be controlled by the onboard controller. Embodiments of the transformer coils can be similar or identical to retail mobile phone wireless chargers.

Another aspect of the assembly can include limit switches. Some versions comprise microswitches, such as one at each end of the carriage travel. The state of the limit switches can be interpreted by the controller to detect when the carriage/spindle assembly is at either end of travel. The limit switches are optional.

At 802, the pedal rotational position is received, e.g., at the controller 112 or computing device 423. The rotational position of the pedal can be used to compute the rotational velocity or rotational speed of the pedals. Any change in velocity can indicate a change in acceleration.

At 803, motor control signals are output. The one or more control signals output to the electric motor 114 can cause the electric motor 114 to control rotational inertia at the pedals based at least upon the pedal force value, a set pedal resistance value, and a pedal velocity. The pedal velocity can be computed from the position of the pedal over time. The pedal resistance value can be set in during programming an exercise regimen or a rehabilitation regimen, e.g., through an I/O in the base 110 from a remote server and stored in the memory 113. In an example embodiment, if the pedal velocity is being maintained and the pedal force value is within a set range (which can be stored in the memory), a maintain-drive control signal is sent to the electric motor 114. The maintain-drive control signal operates the electric motor 114 to stay at a same mechanical drive output to the pedals, which will maintain a feel at the pedals that is the same, i.e., the inertia remains the same. In an example embodiment, if the pedal velocity is being maintained and the pedal force value is less than a prior pedal force value at a prior pedal revolution (e.g., the pedal velocity is maintained with less force than the previous pedal revolution in the same pedal position but during the immediately prior revolution), the maintain-drive control signal is sent.

In some embodiments, if the pedal velocity is less than a prior pedal velocity during a prior pedal revolution and the pedal force value is less than a prior pedal force value at the prior pedal revolution, an increase-motor-drive control signal can be sent to the electric motor 114. The increase-motor-drive control signal will cause the electric motor to rotate faster, i.e., accelerate, to increase the perceived inertial force at the pedals.

If the pedal force value is greater than the pedal force value during a prior pedal revolution or if the pedal velocity is greater than a prior pedal velocity during the prior pedal revolution, a decrease-motor-drive control signal can be sent to the electric motor. This will slow the electric motor and reduce the force at the pedals. The decrease-motor-drive control signal can be sent when the pedal velocity is more than a prior pedal velocity during a prior pedal revolution. The decrease-motor-drive control signal can be sent when the pedal force value is more than a pedal force value during a prior pedal revolution.

The control signals can cause the electric motor to control simulated rotational inertia applied to the pedals through an intermediate drive wheel connected to a drive axle to the pedals. This will simulate an inertial force perceived at the pedals by the user, where the inertial force would be provided by a flywheel in a traditional stationary exercise machine. This is useful in the present rehabilitation system as the electric motor 114 and any intermediate drive linkage between the electric motor 114 and the pedals (e.g., an intermediate drive wheel or pulley) is essentially free from or without adding inertial energy to the pedals.

Figure 9:
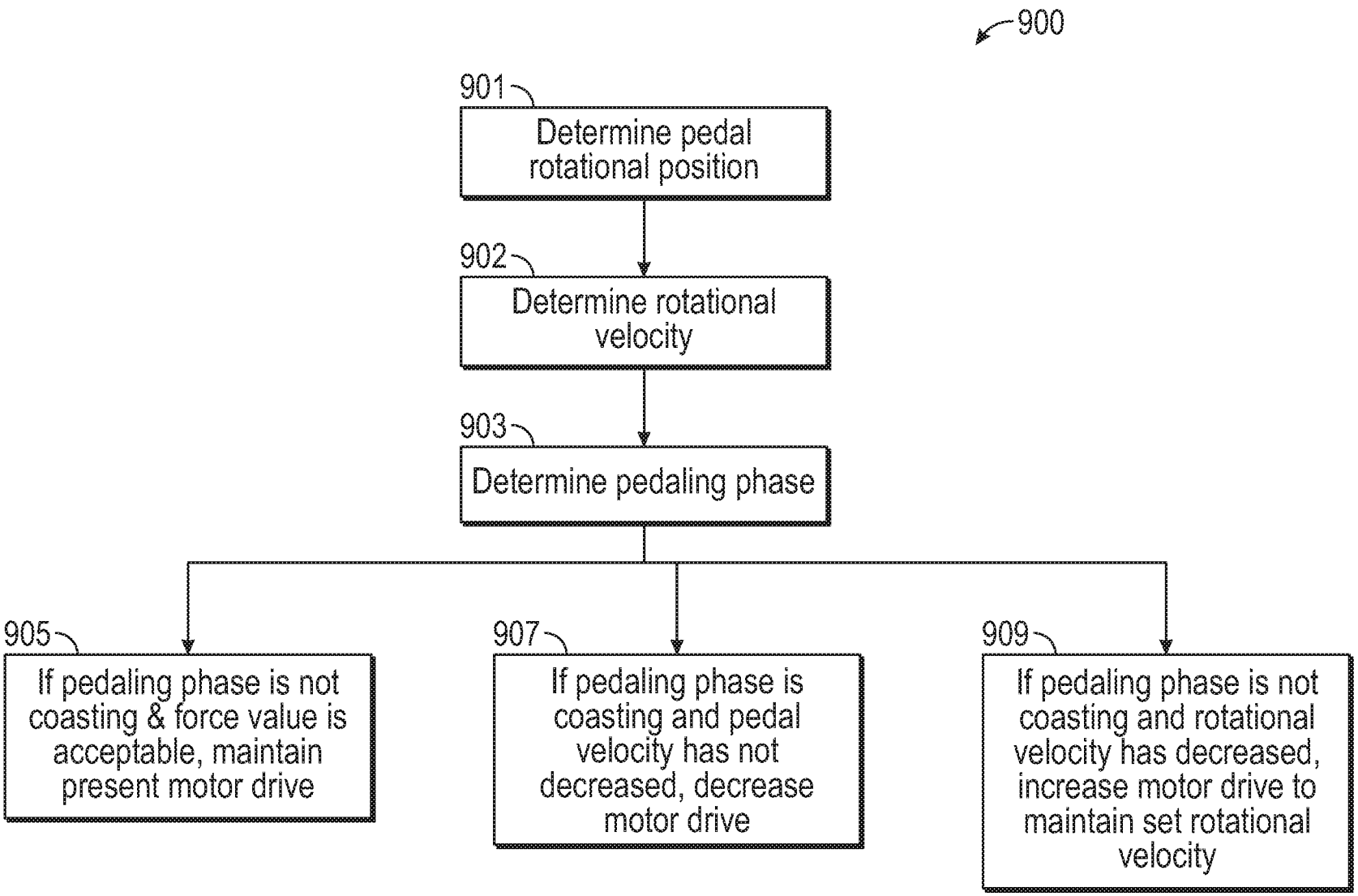
FIG. 9 is a flowchart of a method for operating the rehabilitation/exercise system in accordance with the present disclosure.

FIG. 9 is a method 900 for simulating a flywheel and controlling the force at the pedal as perceived by the user. At 901, the pedal position is determined. The pedal position can be determined by sensors on the pedals or by measuring the position of the spindle or axle. The position of the axle can be determined by reading the indicia on the axle as it turns. The pedals are fixed to the axle through the pedal arm assembly, and the radial position of the pedals is known as it is set by the control arm assembly. At 902, the rotational velocity of the pedals is determined. At 903, the pedaling phase is determined. The pedaling phase can be a phase in a rehabilitation regimen. For example, a phase can be an active phase with the user pedaling with force or a coasting phase where the user is pedaling slowly without applying much force to the pedals.

The method 900 then has three different ways it can produce electric motor control signals to control the operation of the electric motor driving the pedals. At 905, if the pedaling phase is not in a coasting phase and the sensed-force value is in a set range, a signal is sent to the electric motor to maintain a current drive of the electric motor at a present drive state to simulate a desired inertia on the one or more pedals. The force value can be set in memory of the device, e.g., as part of the rehabilitation regimen for the user. The force can be set as a value with a +/− buffer to establish a range. For example, when beginning a rehabilitation regimen, the force can be low for the first few pedaling events and increase thereafter. The force can be measured at the pedal using the devices and methods described herein.

At 907, if the pedaling phase is in the coasting phase and the rotational velocity has not decreased, decrease the current drive of the electric motor and maintain a decreasing inertia on the one or more pedals. This should simulate inertia at the pedals, e.g., simulate a flywheel when the system is slowing gradually. The electric motor will continue to apply a force to the pedals, but the force decreases with each revolution of the pedals or over time to simulate the flywheel producing the inertial force.

At 909, if the pedaling phase is not in the coasting phase and the rotational velocity has decreased, increase drive of the electric motor to maintain a desired rotational velocity. That is, the electric motor will accelerate the pedals to maintain the force at the pedals as perceived by the user. The increase in the drive by the electric motor can be maintained for a time period or a number of revolutions of the pedals. In an example embodiment, the electric motor 114 increases the drive for ⅛, ¼, or ⅜ of a revolution of the pedal.

The controller as described herein can output motor control signals that control the force output by the electric motor to the pedals. The controller is configured to increase drive of the electric motor to increase the rotational velocity of the one or more pedals when the one or more pedals are at or below a minimum sensed-force threshold, and to decrease drive to reduce the rotational velocity of the one or more pedals when the one or more pedals are at a maximum sensed-force threshold. The minimum sensed-force threshold and the maximum sensed-force threshold are the forces sensed at the pedals. The values of the minimum and the maximum can be set in the program for an individual's rehabilitation schedule on the rehabilitation system. The program should limit the range of motion of the user by adjusting the radial position of the pedals and control the amount of force that the user can apply to the pedals. For the force to be at any given value, the amount of force applied to the pedals requires that pedals resist the force being applied. That is, if the pedal will free spin above a maximum force, then the user cannot apply more than that force to the pedal. The electric motor can also resist the rotational movement of the pedals by refusing to turn until the minimum force is applied to the pedals. The controller, through output of control signals to the electric motor, simulates a flywheel by controlling operation of the electric motor to drive the pulley (or axle wheel) when the one or more pedals are not rotating in a desired range of either force or rotational velocity.

The force value in the controller can be the sum of forces to maintain a level of drive at the one or more pedals below a peak of the sum of forces and above a valley of the sum of forces. That is, the sum of forces is derived from the forces at both the pedals, one of which can be engaged by a user's good leg and the other by the user's leg in need of exercise or rehabilitation.

The foregoing description of the embodiments describes some embodiments with regard to exercise system or a rehabilitation system or both. These phrases are used for convenience of description. The phrases exercise system or rehabilitation system as used herein include any device that is driven by or causes motion of a person or animal, typically to provide travel of body parts. The exercise system can include devices that cause travel of an extremity or appendage, i.e., a leg, an arm, a hand, or a foot. Other embodiments of exercise systems or rehabilitation systems can be designed for range of motion of joints.

The foregoing description describes a pedal, which is engaged by a user's foot to impart force to the pedal and rotate the pedals along a travel path defined by the position of the pedal relative to the rotational axis of the device. The description relating to a pedal herein can also be applied to handgrips such that a user can grip the handgrips and the device can operate in the same manner as described herein. In an example embodiment, the term pedal can include a handgrip.

The rehabilitation and exercise device, as described herein, may take the form as depicted of a traditional exercise/rehabilitation device which is non-portable and remains in a fixed location, such as a rehabilitation clinic or medical practice. In another example embodiment, the rehabilitation and exercise device may be configured to be a smaller, lighter and more portable unit so that it is able to be easily transported to different locations at which rehabilitation or treatment is to be provided, such as a plurality of patients' homes, alternative care facilities or the like.

Consistent with the above disclosure, the examples of systems and method enumerated in the following clauses are specifically contemplated and are intended as a non-limiting set of examples.

Clause 1. An electromechanical device for rehabilitation, comprising:

one or more pedals coupled to one or more radially-adjustable couplings connected to an axle, the one or more pedals including one or more sensors to measure pedal force applied to the one or more pedals;

a pulley fixed to the axle and defining a rotational axis for the one or more pedals;

an electric motor coupled to the pulley to provide a driving force to the one or more pedals via the pulley;

a control system comprising one or more processing devices operably coupled to the electric motor to simulate a flywheel, wherein the one or more processing devices are configured to:

receive a sensed-force value applied to the one or more pedals by a user;

determine a pedal rotational position;

determine a rotational velocity of the one or more pedals;

based on the sensed-force value and the pedal rotational position, detect a pedaling phase; and (a) if the pedaling phase is not in a coasting phase and the sensed-force value is in a set range, maintain a current driving force of the electric motor to simulate a desired inertia on the one or more pedals;

(b) if the pedaling phase is in the coasting phase and the rotational velocity has not decreased, decrease the driving force of the electric motor and maintain a decreasing inertia on the one or more pedals; and (c) if the pedaling phase is not in the coasting phase and the rotational velocity has decreased, increase the driving force of the electric motor to maintain a desired rotational velocity.

Clause 2. The electromechanical device of any preceding clause, wherein, for option (c), the one or more processing devices increase drive of the electric motor for between one eighth and three eighths of a revolution of the one or more pedals.

Clause 3. The electromechanical device any preceding clause, wherein the one or more sensors include a toe sensor at a toe end of the one or more pedals and a heel sensor at a heel end of the one or more pedals; and wherein the control system uses both a toe signal from the toe sensor and a heel signal from the heel sensor to determine the sensed-force value on the one or more pedals.

Clause 4. The electromechanical device any preceding clause, wherein the one or more processing devices are further configured to:

if the one or more pedals are at or below a minimum sensed-force threshold, increase the driving force of the electric motor to increase the rotational velocity of the one or more pedals; and if the one or more pedals are at a maximum sensed-force threshold, decrease the driving force to reduce the rotational velocity of the one or more pedals.

Clause 5. The electromechanical device of preceding clause, wherein the control system simulates the flywheel by controlling the electric motor to provide the driving force to the pulley when the one or more pedals are not rotating within a desired range.

Clause 6. The electromechanical device of preceding clause, wherein the one or more pedals include a right pedal and a left pedal that both alternatingly apply pedal forces to the electric motor through the pulley, wherein the one or more processing devices use a sum of forces from the right pedal and the left pedal to the driving force output by the electric motor.

Clause 7. The electromechanical device of preceding clause, wherein the one or more processing devices use a sum of forces from a right pedal and a left pedal to maintain a level of drive at the one or more pedals below a peak of the sum of forces and above a valley of the sum of forces.

Clause 8. The electromechanical device of preceding clause, wherein the pulley is does not supply inertia through the one or more pedals without the driving force from the electric motor.

Clause 9. An electromechanical device for rehabilitation, comprising:

one or more pedals coupled to one or more radially-adjustable couplings connected to an axle;

one or more force sensors on the one or more pedals to sense applied to the one or more pedals by a user;

a wheel fixed to the axle and defining a rotational axis for the one or more pedals;

an electric motor coupled to the wheel to provide a driving force to the one or more pedals via the wheel and the one or more radially-adjustable couplings;

a control system comprising one or more processing devices operably coupled to the electric motor to simulate a flywheel, wherein the one or more processing devices are configured to:

receive a sensed-force value representing a pedal force applied onto the one or more pedals by the user;

if the sensed-force value is in a desired range, maintain the driving force at a present drive state;

if the sensed-force value is above the desired range, decrease the driving force to the one or more pedals; and if the sensed-force value is below the desired range, increase the driving force to the one or more pedals.

Clause 10. The electromechanical device of preceding clause, wherein the one or more force sensors include a toe sensor at a toe end of the one or more pedals and a heel sensor at a heel end of the one or more pedals, and wherein the sensed-force value is a calculated force from both the toe sensor and the heel sensor.

Clause 11. The electromechanical device of preceding clause, wherein the electric motor controls a resistance to travel of the one or more pedals.

Clause 12. The electromechanical device of preceding clause, wherein the one or more pedals include a right pedal and a left pedal that both periodically receive applied force from the user and the electric motor resists the applied force, wherein the one or more processing devices use a sum of forces from the right pedal and the left pedal to control the driving force the electric motor to resist acceleration and deceleration of rotational velocity of the one or more pedals.

Clause 13. The electromechanical device of preceding clause, wherein the one or more processing devices use the sum of forces to maintain a desired level of force at the one or more pedals below a peak of the sum of forces and above a valley of the sum of forces.

Clause 14. A method of electromechanical rehabilitation, comprising:

receiving a pedal force value from a pedal sensor of a pedal;

receiving a pedal rotational position;

based on the pedal rotational position over a period of time, calculating a pedal velocity; and based at least upon the pedal force value, a set pedal resistance value, and the pedal velocity, outputting one or more control signals causing an electric motor to provide a driving force to control simulated rotational inertia applied to the pedal.

Clause 16. The method of preceding clause, wherein, if the pedal velocity is being maintained and the pedal force value is within a set range, outputting the one or more control signals comprises outputting a maintain-drive control signal to the electric motor; and wherein the maintain-drive control signal causes the electric motor to keep the driving force at a current driving force.

Clause 16. The method of preceding clause, wherein, if the pedal velocity is being maintained and the pedal force value is less than a prior pedal force value at a prior pedal revolution, outputting the one or more control signals includes outputting a maintain-drive control signal to the electric motor; and wherein the maintain-drive control signal causes the electric motor to keep the driving force at a current driving force.

Clause 17. The method of preceding clause, wherein, if the pedal velocity is less than a prior pedal velocity during a prior pedal revolution and the pedal force value is less than a prior pedal force value at the prior pedal revolution, outputting the one or more control signals includes outputting an increase-motor-drive control signal to the electric motor; and wherein the increase-motor-drive control signal causes the electric motor to increase the driving force relative to a current driving force.

Clause 18. The method of preceding clause, wherein, if the pedal force value is greater than the pedal force value during a prior pedal revolution or if the pedal velocity is greater than a prior pedal velocity during the prior pedal revolution, outputting the one or more control signals includes outputting a decrease-motor-drive control signal to the electric motor; and wherein the increase-motor-drive control signal causes the electric motor to increase the driving force relative to a current driving force.

Clause 19. The method of preceding clause, wherein outputting the one or more control signals causes the electric motor to control simulated rotational inertia applied to the pedal through an intermediate drive wheel connected to a drive axle to the pedal; and wherein outputting the one or more control signals causes the electric motor to control simulated rotational inertia with the intermediate drive wheel without adding inertial energy to the pedal.

Clause 20. The method of preceding clause, wherein the pedal sensor includes a toe sensor at a toe end of the pedal and a heel sensor at a heel end of the pedal; and wherein receiving the pedal force value from the pedal sensor includes sensing a toe end force from the toe sensor and sensing a heel end force from the heel sensor and computing a total force from both the toe end force and the heel end force.

The foregoing description of the embodiments has been provided for purposes of illustration and description. It is not intended to be exhaustive or to limit the disclosure. Individual elements, assemblies/subassemblies, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure. The benefits, advantages, solutions to problems, and any feature(s) that can cause any benefit, advantage, or solution to occur or become more pronounced are not to be construed as a critical, required, sacrosanct or an essential feature of any or all the claims.

What is claimed is:

1. An electromechanical device for rehabilitation, comprising:

pedals coupled to radially-adjustable couplings connected to an axle, the pedals including sensors to measure pedal force applied to the pedals;

a pulley coupled to the axle and defining a rotational axis for the pedals;

an electric motor coupled to the pulley and configured to provide a driving force to the pedals via the pulley;

a control system comprising a processing device operably coupled to the electric motor to simulate a flywheel, wherein the processing device is configured to:

receive a sensed-force value applied to the pedals by a user;

determine a pedal rotational position;

determine a rotational velocity of the pedals;

based on the sensed-force value and the pedal rotational position, detect a pedaling phase; and (a) if the pedaling phase is not in a coasting phase and the sensed-force value is within a desired range, maintain a current driving force of the electric motor to simulate a desired inertia of the pedals;

(b) if the pedaling phase is in the coasting phase and the rotational velocity has not decreased, decrease the driving force of the electric motor and maintain a decreasing inertia of the pedals; and (c) if the pedaling phase is not in the coasting phase and the rotational velocity has decreased, increase the driving force of the electric motor to maintain a desired rotational velocity.

2. The electromechanical device of claim 1 wherein, for option (c), the processing device increases drive of the electric motor for between one eighth and three eighths of a revolution of the pedals.

3. The electromechanical device of claim 1, wherein the sensors include a toe sensor at a toe end of the pedals and a heel sensor at a heel end of the pedals; and wherein the control system uses both a toe signal from the toe sensor and a heel signal from the heel sensor to determine the sensed-force value on the pedals.

4. The electromechanical device of claim 1, wherein the processing device is further configured to:

if the pedals are at or below a minimum sensed-force threshold, increase the driving force of the electric motor to increase the rotational velocity of the pedals; and if the pedals are at a maximum sensed-force threshold, decrease the driving force to reduce the rotational velocity of the pedals.

5. The electromechanical device of claim 1, wherein the control system simulates the flywheel by controlling the electric motor to provide the driving force to the pulley when the pedals are not rotating within the desired range.

6. The electromechanical device of claim 1, wherein the pedals include a right pedal and a left pedal that alternatingly apply pedal forces to the electric motor through the pulley, wherein the processing device uses a sum of forces from the right pedal and the left pedal to the driving force output by the electric motor.

7. The electromechanical device of claim 1, wherein the processing device uses a sum of forces from a right pedal and a left pedal to maintain a level of drive at the pedals below a peak of the sum of forces and above a valley of the sum of forces.

8. The electromechanical device of claim 1, wherein the pulley does not supply inertia through the pedals without the driving force from the electric motor.

9. An electromechanical device for rehabilitation, comprising:

pedals coupled to radially-adjustable couplings connected to an axle;

force sensors on the pedals configured to sense a pedal force applied to the pedals by a user;

a wheel coupled to the axle and defining a rotational axis for the pedals;

an electric motor coupled to the wheel and configured to provide a driving force to the pedals via the wheel and the radially-adjustable couplings;

a control system comprising a processing device operably coupled to the electric motor to simulate a flywheel, wherein the processing device is configured to:

receive a sensed-force value representing the pedal force applied to the pedals by the user;

if the sensed-force value is in a range, maintain the driving force at a present drive state;

if the sensed-force value is above the range, decrease the driving force to the pedals; and if the sensed-force value is below the range, increase the driving force to the pedals.

10. The electromechanical device of claim 9, wherein the force sensors include a toe sensor at a toe end of the pedals and a heel sensor at a heel end of the pedals, and the sensed-force value is a calculated force from the toe sensors and the heel sensors.

11. The electromechanical device of claim 9, wherein the electric motor controls a resistance to travel of the pedals.

12. The electromechanical device of claim 9, wherein the pedals include a right pedal and a left pedal that both periodically receive applied force from the user and the electric motor resists the applied force, wherein the processing device uses a sum of forces from the pedals to control the driving force the electric motor to resist acceleration and deceleration of rotational velocity of the pedals.

13. The electromechanical device of claim 12, wherein the processing device uses the sum of forces to maintain a desired level of force at the pedals below a peak of the sum of forces and above a valley of the sum of forces.

14. A method of electromechanical rehabilitation, comprising:

receiving a pedal force value from a pedal sensor of a pedal;

receiving a pedal rotational position;

based on the pedal rotational position over a period of time, calculating a pedal velocity; and based at least upon the pedal force value, a set pedal resistance value, and the pedal velocity, outputting one or more control signals causing an electric motor to provide a driving force to control simulated rotational inertia applied to the pedal;

wherein, if the pedal velocity is being maintained and the pedal force value is within a set range, outputting the control signals comprises outputting a maintain-drive control signal to the electric motor; and wherein the maintain-drive control signal causes the electric motor to maintain the driving force at a current driving force.

15. The method of claim 14, wherein, if the pedal velocity is being maintained and the pedal force value is less than a prior pedal force value at a prior pedal revolution, outputting the control signals includes outputting a maintain-drive control signal to the electric motor; and wherein the maintain-drive control signal causes the electric motor to keep the driving force at a current driving force.

16. The method of claim 14, wherein, if the pedal velocity is less than a prior pedal velocity during a prior pedal revolution and the pedal force value is less than a prior pedal force value at the prior pedal revolution, outputting the control signals includes outputting an increase-motor-drive control signal to the electric motor; and wherein the increase-motor-drive control signal causes the electric motor to increase the driving force relative to a current driving force.

17. The method of claim 14, wherein, if the pedal force value is greater than the pedal force value during a prior pedal revolution or if the pedal velocity is greater than a prior pedal velocity during the prior pedal revolution, outputting the control signals includes outputting a decrease-motor-drive control signal to the electric motor; and wherein the increase-motor-drive control signal causes the electric motor to increase the driving force relative to a current driving force.

18. The method of claim 14, wherein outputting the control signals causes the electric motor to control simulated rotational inertia applied to the pedal through an intermediate drive wheel connected to a drive axle to the pedal; and wherein outputting the control signals causes the electric motor to control simulated rotational inertia with the intermediate drive wheel without adding inertial energy to the pedal.

19. The method of claim 14, wherein the pedal sensor includes a toe sensor at a toe end of the pedal and a heel sensor at a heel end of the pedal; and wherein receiving the pedal force value from the pedal sensor includes sensing a toe end force from the toe sensor and sensing a heel end force from the heel sensor and computing a total force from both the toe end force and the heel end force.

* * * * *